US009698000B2

(12) United States Patent
Liepert et al.

(10) Patent No.: US 9,698,000 B2
(45) Date of Patent: Jul. 4, 2017

(54) INTEGRATED MASS SPECTROMETRY SYSTEMS

(71) Applicant: 908 Devices Inc., Boston, MA (US)

(72) Inventors: Tony Liepert, Lincoln, MA (US); Kevin McCallion, Winchester, MA (US); Christopher D. Brown, Los Gatos, CA (US); Kevin J. Knopp, Brookline, MA (US); Michael Jobin, Boston, MA (US)

(73) Assignee: 908 Devices Inc., Boston, MA (US)

( * ) Notice: Subject to any disclaimer, the term of this patent is extended or adjusted under 35 U.S.C. 154(b) by 61 days.

(21) Appl. No.: 14/927,886

(22) Filed: Oct. 30, 2015

(65) Prior Publication Data

US 2016/0126078 A1 May 5, 2016

Related U.S. Application Data

(60) Provisional application No. 62/073,470, filed on Oct. 31, 2014.

(51) Int. Cl.
*H01J 49/24* (2006.01)
*H01J 49/00* (2006.01)

(52) U.S. Cl.
CPC ..... *H01J 49/24* (2013.01); *H01J 49/0022* (2013.01)

(58) Field of Classification Search
CPC ..... H01J 49/0013; H01J 49/0018; H01J 49/0022; H01J 49/0027; H01J 49/0031; H01J 49/26; H01J 49/42; H01J 49/4205
See application file for complete search history.

(56) References Cited

U.S. PATENT DOCUMENTS

2002/0033448 A1* 3/2002 Berger ..... G06Q 20/00 250/296
2011/0286864 A1* 11/2011 Stones ..... F04D 19/046 417/244
2012/0138790 A1* 6/2012 Wright ..... H01J 49/0013 250/288

* cited by examiner

*Primary Examiner* — David E Smith
(74) *Attorney, Agent, or Firm* — Fish & Richardson P.C.

(57) ABSTRACT

The disclosure features mass spectrometry systems that include: an ion source; a module featuring an ion trap, an ion detector, and a module housing that at least partially surrounds the ion trap and the ion detector; and a vacuum pump featuring a housing having a recess dimensioned to receive the module, so that when the module is positioned within the recess of the vacuum pump housing, a portion of the module is surrounded by the vacuum pump housing, and during operation of the system, the ion source, ion trap, ion detector, and vacuum pump are connected along a common gas flow path and heat is transferred from the vacuum pump to the module.

31 Claims, 16 Drawing Sheets

INTEGRATED MASS SPECTROMETRY SYSTEMS

CROSS-REFERENCE TO RELATED APPLICATIONS

This application claims priority to U.S. Provisional Patent Application No. 62/073,470, filed on Oct. 31, 2014, the entire contents of which are incorporated herein by reference.

TECHNICAL FIELD

This disclosure relates to mass spectrometry systems.

BACKGROUND

Mass spectrometers are widely used for the detection of chemical substances. In a typical mass spectrometer, molecules or particles are excited or ionized, and these excited species often break down to form ions of smaller mass or react with other species to form other characteristic ions. The ion formation pattern can be interpreted by a system operator to infer the identity of the compound.

SUMMARY

This disclosure describes techniques and systems for obtaining mass spectrometry information about positively and negatively charged particles (e.g., ions). In particular, the disclosed mass spectrometry systems can be implemented in a compact form and operate at high pressure during the measurement of mass spectrometry information. In some embodiments, for example, the systems can be implemented in modular form in which certain system components can be selectively added, removed, or interchanged. Electrical and fluid connections between system components can be formed automatically when modular components are engaged with one another. Further, the systems disclosed herein can be configured for low power operation by selectively adjusting various operating parameters of the systems.

The mass spectrometry systems disclosed herein can also be implemented in a compact form factor in which a module that includes at least one of the ion source, ion trap, and ion detector is positioned within a recess of a vacuum pump housing. In this manner, fluid conduits that might otherwise be used to connect the ion source, ion trap, and/or ion detector to the pump are shortened or even eliminated, and the total enclosed volume of the system is reduced. With a smaller total enclosed volume to pump down, the vacuum pump consumes less power and can more rapidly adjust the internal gas pressure of the system.

In general, in a first aspect, the disclosure features mass spectrometry systems that include: a module featuring an ion source, an ion trap, an ion detector, and a module housing that includes a first thermal transfer surface; and a vacuum pump featuring a housing having a recess dimensioned to receive the module and including a second thermal transfer surface, where when the module is positioned within the recess of the vacuum pump housing, a portion of the module is surrounded by the vacuum pump housing, and where during operation of the system, when the module is positioned within the recess of the vacuum pump housing, the ion source, ion trap, ion detector, and vacuum pump are connected along a common gas flow path, and the first thermal transfer surface contacts the second thermal transfer surface to transfer heat from the vacuum pump to the module.

Embodiments of the systems can include any one or more of the following features.

The common gas flow path can have a volume of 5 $cm^3$ or less (e.g., 3 $cm^3$ or less). The vacuum pump can be a scroll pump featuring interleaved scroll flanges. A minimum length of the common gas flow between the ion source and the interleaved scroll flanges can be 2 cm or less. The interleaved scroll flanges can include a fixed flange and a movable flange, and the fixed flange can be positioned closer to the recess than the movable flange.

The module can be configured to form a sealed connection with the vacuum pump when the module is received within the recess, and at least some surfaces of contact between the module and the recess can be gasketless. The first thermal transfer surface can include an exterior surface of a cylindrical member.

During operation, the vacuum pump can be configured to maintain a gas pressure within the common gas flow path of between 10 mTorr and 100 Torr. During operation, the vacuum pump can be configured to maintain the gas pressure so that gas pressures among the ion source, the ion trap, and the ion detector differ by less than 100 mTorr.

The module can include a first gas flow path, the vacuum pump can include a second gas flow path, and the first and second gas flow paths can extend along a common axis to form the common gas flow path. The module can include a sample inlet having an inlet flow path extending in a direction perpendicular to the first gas flow path and connected to the first gas flow path.

The module can include a first gas flow path, the vacuum pump can include an internal axis of rotation, and the first gas flow path and the axis of rotation can extend in different directions. The first gas flow path and the axis of rotation can extend in perpendicular directions.

The module can include a plurality of electrical connectors extending from a surface of the module that is not received within the recess, and during operation, when the module is positioned within the recess, the plurality of electrical connectors can engage with a support structure that includes an electronic processor. The electronic processor can be configured to control the ion source, the ion trap, the ion detector, and the vacuum pump.

The module can include a plurality of electrical connectors extending from a surface of the module that is received within the recess, the vacuum pump can include a plurality of corresponding electrical connectors configured to engage with the connectors of the module, and during operation, when the module is positioned within the recess, the module can be electrically connected to an electronic processor through the connectors of the vacuum pump. The electronic processor can be configured to control the ion source, the ion trap, the ion detector, and the vacuum pump.

The recess and an exterior surface of the module can be shaped so that the module can be received within the recess in only one orientation. The recess can be dimensioned so that when the module is positioned within the recess, the housing entirely surrounds an exterior surface of the module. The recess can be dimensioned so that when the module is positioned within the recess, the housing entirely surrounds more than one exterior surface of the module.

The recess can be dimensioned so that when the module is positioned within the recess, the housing entirely surrounds all but one exterior surface of the module. The recess can include a cavity, and the module can include a protruding member dimensioned to be received within the cavity when the module is received within the recess. The protruding member can be formed from a metallic material. The recess can include a plurality of cavities, and the module can include a plurality of corresponding protruding members dimensioned to be received within the cavities when the module is received within the recess.

The module can include a cavity, and the vacuum housing can include a protruding member dimensioned to be received within the cavity when the module is received within the recess. The module can include a plurality of cavities, and the vacuum housing can include a plurality of protruding members dimensioned to be received within the cavities when the module is received within the recess.

Embodiments of the systems can also include any of the other features and aspects disclosed herein, including features and aspects disclosed in connection with different embodiments, in any combination as appropriate.

In another aspect, the disclosure features mass spectrometry systems that include: a module featuring an ion source, an ion trap, an ion detector, and a module housing featuring a first thermal transfer surface; and a vacuum pump featuring a housing having a recess dimensioned to receive the module and including a second thermal transfer surface, where during operation of the system, when the module is positioned within the recess of the vacuum pump housing, the ion source, ion trap, ion detector, and vacuum pump are connected along a common gas flow path, the first thermal transfer surface contacts the second thermal transfer surface to transfer heat from the vacuum pump to the module, and a maximum distance between the ion source and the vacuum pump housing, measured along a direction defined by a central axis of the module, is 2 cm or less.

Embodiments of the systems can include any one or more of the following features.

The maximum distance between the ion source and the vacuum pump housing can be 1 cm or less. When the module is positioned within the recess of the vacuum pump housing, a maximum distance between the ion trap and the vacuum pump housing, measured along the direction defined by the central axis of the module, can be 1.5 cm or less. When the module is positioned within the recess of the vacuum pump housing, a maximum distance between the ion detector and the vacuum pump housing, measured along the direction defined by the central axis of the module, is 1 cm or less. The common gas flow path can have a volume of 5 $cm^3$ or less (e.g., 3 $cm^3$ or less).

The module can be configured to form a sealed connection with the vacuum pump when the module is received within the recess, and at least some surfaces of contact between the module and the recess can be gasketless. The first thermal transfer surface can include an exterior surface of a cylindrical member.

During operation, the vacuum pump can be configured to maintain a gas pressure within the common gas flow path of between 10 mTorr and 100 Torr. During operation, the vacuum pump can be configured to maintain the gas pressure so that gas pressures among the ion source, the ion trap, and the ion detector differ by less than 100 mTorr.

The module can include a first gas flow path, the vacuum pump can include a second gas flow path, and the first and second gas flow paths can extend along a common axis to form the common gas flow path. The module can include a sample inlet having an inlet flow path extending in a direction perpendicular to the first gas flow path and connected to the first gas flow path.

The module can include a first gas flow path, the vacuum pump can include an internal axis of rotation, and the first gas flow path and the axis of rotation can extend in different directions. The first gas flow path and the axis of rotation can extend in perpendicular directions.

The module can include a plurality of electrical connectors extending from a surface of the module that is not received within the recess, and during operation, when the module is positioned within the recess, the plurality of electrical connectors can engage with a support structure that includes an electronic processor. The electronic processor can be configured to control the ion source, the ion trap, the ion detector, and the vacuum pump.

The module can include a plurality of electrical connectors extending from a surface of the module that is received within the recess, the vacuum pump can include a plurality of corresponding electrical connectors configured to engage with the connectors of the module, and during operation, when the module is positioned within the recess, the module can be electrically connected to an electronic processor through the connectors of the vacuum pump. The electronic processor can be configured to control the ion source, the ion trap, the ion detector, and the vacuum pump.

The recess and an exterior surface of the module can be shaped so that the module can be received within the recess in only one orientation. The recess can be dimensioned so that when the module is positioned within the recess, the housing entirely surrounds an exterior surface of the module. The recess can be dimensioned so that when the module is positioned within the recess, the housing entirely surrounds more than one exterior surface of the module. The recess can be dimensioned so that when the module is positioned within the recess, the housing entirely surrounds all but one exterior surface of the module.

The recess can include a cavity, and the module can include a protruding member dimensioned to be received within the cavity when the module is received within the recess. The protruding member can be formed from a metallic material. The recess can include a plurality of cavities, and the module can include a plurality of corresponding protruding members dimensioned to be received within the cavities when the module is received within the recess.

The module can include a cavity, and the vacuum housing can include a protruding member dimensioned to be received within the cavity when the module is received within the recess. The module can include a plurality of cavities, and the vacuum housing can include a plurality of protruding members dimensioned to be received within the cavities when the module is received within the recess.

Embodiments of the systems can also include any of the other features and aspects disclosed herein, including features and aspects disclosed in connection with different embodiments, in any combination as appropriate.

In a further aspect, the disclosure features methods that include: (a) introducing a sample into a mass spectrometry system that features a module that includes an ion source, an ion trap, an ion detector, and a module housing with a first thermal transfer surface, and a vacuum pump featuring a housing having a recess dimensioned to receive the module and including a second thermal transfer surface, where when the module is positioned within the recess of the vacuum pump housing, a portion of the module is surrounded by the vacuum pump housing, and where during operation of the system, when the module is positioned within the recess of the vacuum pump housing, the ion source, ion trap, ion detector, and vacuum pump are connected along a common gas flow path, and the first thermal transfer surface contacts the second thermal transfer surface to transfer heat from the vacuum pump to the module; (b) generating ions from the sample using the ion source; (c) trapping the generated ions within the ion trap; and (d) selectively ejecting the trapped ions from the ion trap and detecting the ejected ions using the ion detector to determine mass spectral information about the sample.

Embodiments of the methods can include any of the steps and aspects disclosed herein, including steps and aspects disclosed in connection with different embodiments, in any combination as appropriate.

In another aspect, the disclosure features methods that include: (a) introducing a sample into a mass spectrometry system that includes a module featuring an ion source, an ion trap, an ion detector, and a module housing featuring a first thermal transfer surface, and a vacuum pump featuring a housing having a recess dimensioned to receive the module and including a second thermal transfer surface, where during operation of the system, when the module is positioned within the recess of the vacuum pump housing, the ion source, ion trap, ion detector, and vacuum pump are connected along a common gas flow path, the first thermal transfer surface contacts the second thermal transfer surface to transfer heat from the vacuum pump to the module, and a maximum distance between the ion source and the vacuum pump housing, measured along a direction defined by a central axis of the module, is 2 cm or less; (b) generating ions from the sample using the ion source; (c) trapping the generated ions within the ion trap; and (d) selectively ejecting the trapped ions from the ion trap and detecting the ejected ions using the ion detector to determine mass spectral information about the sample.

Embodiments of the methods can include any of the steps and aspects disclosed herein, including steps and aspects disclosed in connection with different embodiments, in any combination as appropriate.

In a further aspect, the disclosure features mass spectrometry systems that include an ion source, a module featuring an ion trap, an ion detector, and a module housing that at least partially surrounds the ion trap and the ion detector, and a vacuum pump that includes a housing having a recess dimensioned to receive the module, where when the module is positioned within the recess of the vacuum pump housing, a portion of the module is surrounded by the vacuum pump housing, and where during operation of the system, when the module is positioned within the recess of the vacuum pump housing: the ion source, ion trap, ion detector, and vacuum pump are connected along a common gas flow path; and heat is transferred from the vacuum pump to the module.

Embodiments of the systems can include any one or more of the following features.

The ion source can be a component of the module. The ion source can be positioned external to the module, and the common gas flow path can extend through the module housing to connect the ion source to the ion trap, ion detector, and vacuum pump.

The module can include a first thermal transfer surface and the vacuum pump housing can include a second thermal transfer surface, and during operation of the system, the first thermal transfer surface can contact the second thermal transfer surface to transfer heat from the vacuum pump to the module.

The common gas flow path can have a volume of 5 $cm^3$ or less (e.g., 3 $cm^3$ or less). The vacuum pump can include one or more of a scroll pump having interleaved scroll flanges, a roots blower pump, and a rotor/stator pump. The vacuum pump can include a scroll pump having interleaved scroll flanges, and a minimum length of the common gas flow between the ion source and the interleaved scroll flanges can be 2 cm or less. The vacuum pump can include a scroll pump having an interleaved fixed flange and a movable flange, and the fixed flange can be positioned closer to the recess than the movable flange.

The module can be configured to form a sealed connection with the vacuum pump when the module is received within the recess, and at least some surfaces of contact between the module and the recess can be gasketless. The first thermal transfer surface can include an exterior surface of a cylindrical member.

During operation, the vacuum pump can be configured to maintain a gas pressure within the common gas flow path of between 10 mTorr and 100 Torr. During operation, the vacuum pump can be configured to maintain the gas pressure so that gas pressures among the ion source, the ion trap, and the ion detector differ by less than 100 mTorr.

The module can include a first gas flow path, the vacuum pump can include a second gas flow path, and the first and second gas flow paths can extend along a common axis to form the common gas flow path. The module can include a sample inlet having an inlet flow path extending in a direction perpendicular to the first gas flow path and connected to the first gas flow path.

The module can include a first gas flow path, the vacuum pump can include an internal axis of rotation, and the first gas flow path and the axis of rotation can extend in different directions. The first gas flow path and the axis of rotation can extend in perpendicular directions.

The module can include a plurality of electrical connectors extending from a surface of the module, and during operation, when the module is positioned within the recess, the plurality of electrical connectors can engage with a support structure featuring an electronic processor. The electronic processor can be configured to control the ion source, the ion trap, the ion detector, and the vacuum pump.

The module can include a plurality of electrical connectors extending from a surface of the module that is received within the recess, the vacuum pump can include a plurality of corresponding electrical connectors configured to engage with the connectors of the module, and during operation, when the module is positioned within the recess, the module can be electrically connected to an electronic processor through the connectors of the vacuum pump. The electronic processor can be configured to control the ion source, the ion trap, the ion detector, and the vacuum pump.

The recess and an exterior surface of the module can be shaped so that the module can be received within the recess in only one orientation. The recess can be dimensioned so that when the module is positioned within the recess, the vacuum pump housing entirely surrounds at least one exterior surface of the module. The recess can be dimensioned so that when the module is positioned within the recess, the vacuum pump housing entirely surrounds more than one exterior surface of the module. The recess can be dimensioned so that when the module is positioned within the recess, the vacuum pump housing entirely surrounds all but one exterior surface of the module.

The recess can include a cavity, and the module can include a protruding member dimensioned to be received within the cavity when the module is received within the recess. The protruding member can be formed from a metallic material. The recess can include a plurality of cavities, and the module can include a plurality of corresponding protruding members dimensioned to be received within the cavities when the module is received within the recess.

The module can include a cavity, and the vacuum pump housing can include a protruding member dimensioned to be received within the cavity when the module is received within the recess. The module can include a plurality of cavities, and the vacuum pump housing can include a plurality of protruding members dimensioned to be received within the cavities when the module is received within the recess.

Embodiments of the systems can also include any of the other features and aspects disclosed herein, including features and aspects disclosed in connection with different embodiments, in any combination as appropriate.

In another aspect, the disclosure features methods that include: (a) introducing a sample into a mass spectrometry system that features an ion source, a module including an ion trap, an ion detector, and a module housing that at least partially surrounds the ion trap and the ion detector, and a vacuum pump featuring a housing having a recess dimensioned to receive the module, where when the module is positioned within the recess of the vacuum pump housing, a portion of the module is surrounded by the vacuum pump housing, and where during operation of the system, when the module is positioned within the recess of the vacuum pump housing, the ion source, ion trap, ion detector, and vacuum pump are connected along a common gas flow path, and heat is transferred from the vacuum pump to the module; (b) generating ions from the sample using the ion source; (c) trapping the generated ions within the ion trap; (d) selectively ejecting the trapped ions from the ion trap and detecting the ejected ions using the ion detector to determine mass spectral information about the sample; and (e) outputting the mass spectral information to at least one of a display unit and a storage unit.

Embodiments of the methods can include any of the steps and aspects disclosed herein, including steps and aspects disclosed in connection with different embodiments, in any combination as appropriate.

Unless otherwise defined, all technical and scientific terms used herein have the same meaning as commonly understood by one of ordinary skill in the art to which this disclosure belongs. Although methods and materials similar or equivalent to those described herein can be used in the practice or testing of the subject matter herein, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

The details of one or more embodiments are set forth in the accompanying drawings and the description below. Other features and advantages will be apparent from the description, drawings, and claims.

Additional aspects and features of the mass spectrometry systems described herein are disclosed, for example, in U.S. Pat. Nos. 8,525,111 and 8,816,272, the entire contents of each of which are incorporated herein by reference.

DESCRIPTION OF DRAWINGS

Like reference symbols in the various drawings indicate like elements.

DETAILED DESCRIPTION

I. General Overview

Figure 1A:
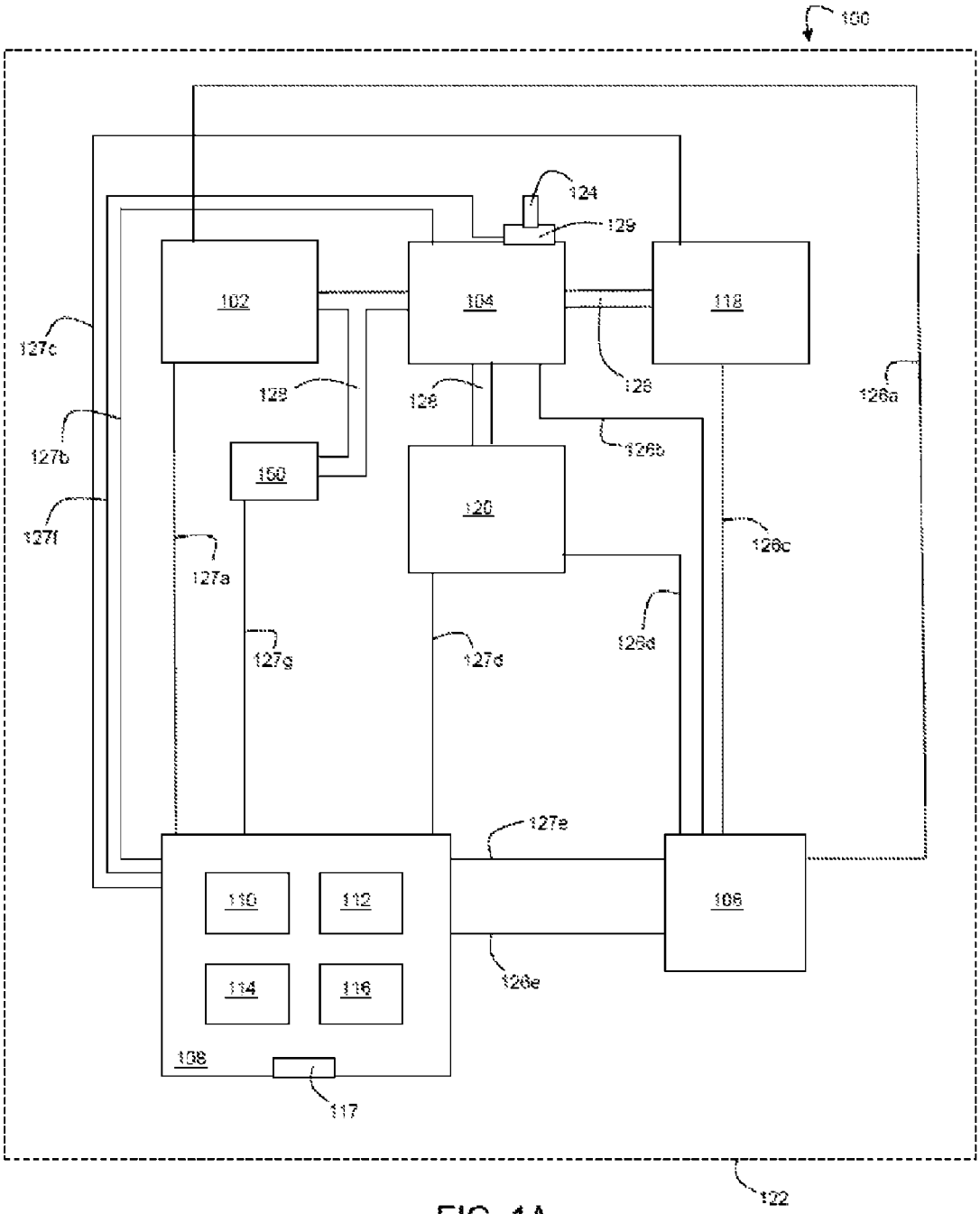
FIG. 1A is a schematic diagram of a compact mass spectrometer.

Mass spectrometers that are used for identification of chemical substances are typically large, complex instruments that consume considerable power. Such instruments are frequently too heavy and bulky to be portable, and thus are limited to applications in environments where they can remain essentially stationary. Further, conventional mass spectrometers are typically expensive and require highly trained operators to interpret the spectra of ion formation patterns that the instruments produce to infer the identities of chemical substances that are analyzed.

To achieve high sensitivity and resolution, conventional mass spectrometers typically use a variety of different components that are designed for operation at low gas pressures. For example, conventional ion detectors such as electron multipliers do not operate effectively at pressures above approximately 10 mTorr. As another example, thermionic emitters that are used in conventional ion sources are also best suited for operation at pressures less than 10 mTorr when oxygen is not present. Further, conventional mass spectrometers typically include mass analyzers with geometries specifically designed only for operation at pressures of less than 10 mTorr, and in particular, at pressures in the microTorr range. As a result, not only are conventional mass spectrometers configured for operation at low pressures, but conventional mass spectrometers—due to the components they use—generally cannot be operated at higher gas pressures. Higher gas pressures can, for example, destroy certain components of conventional spectrometers. Less dramatically, certain components may simply fail to operate at higher gas pressures, or may operate so poorly that the spectrometers can no longer acquire useful mass spectral information. As a result, mass spectrometers with significantly different configurations and components are needed for operation at high pressures (e.g., pressures larger than 100 mTorr).

To achieve low pressures, conventional mass spectrometers typically include a series of pumps for evacuating the interior volume of a spectrometer. For example, a conventional mass spectrometer can include a rough pump that rapidly reduces the internal pressure of the system, and a turbomolecular pump that further reduces the internal pressure to microTorr values. Turbomolecular pumps are large and consume considerable electrical power. Such considerations are only of secondary importance in conventional mass spectrometers, however; the consideration of primary importance is achieving high resolution in measured mass spectra. By using the foregoing components operating at low pressure, conventional mass spectrometers commonly can achieve resolutions of 0.1 atomic mass units (amu) or better.

In contrast to heavy, bulky conventional mass spectrometers, the compact mass spectrometers disclosed herein are designed for low power, high efficiency operation. To achieve low power operation, the compact mass spectrometers disclosed herein do not include turbomechanical or other power hungry vacuum pumps. Instead, the compact mass spectrometers typically include only a single mechanical pump operating at low frequency, which reduces power consumption significantly.

By using smaller pumps, the compact mass spectrometers disclosed herein typically operate within a pressure range of 100 mTorr to 100 Torr, which is significantly higher than the operating pressure range for conventional mass spectrometers. Conventional mass spectrometers are not modifiable to operate at these higher pressures, because the components used in conventional instruments (e.g., electron multipliers, thermionic emitters, and ion trap) do not function within the pressure range in which the compact mass spectrometers disclosed herein operate. Further, conventional mass spectrometers are generally not modified to operate at higher internal pressures, because doing so typically would result in poorer resolution in the mass spectra measured with such devices. Because obtaining mass spectra with the highest possible resolution is generally the goal when using such devices, there is little reason to modify the devices to provide poorer resolution.

However, the compact mass spectrometers disclosed herein provide different types of information to a user than conventional mass spectrometers. Specifically, the compact mass spectrometers disclosed herein typically report information such as a name of a chemical substance being analyzed, hazard information associated with the substance, and/or a class to which the substance belongs. The compact mass spectrometers disclosed herein can also report, for example, whether the substance either is or is not a particular target substance. Typically, the mass spectra recorded are not displayed to the user unless the user activates a control that causes the display of the spectra. As a result, unlike conventional mass spectrometers, the compact mass spectrometers disclosed herein do not need to obtain mass spectra with the highest possible resolution. Instead, as long as the spectra obtained are of high enough quality to determine the information that is reported to the user, further increases in resolution are not a critical performance criterion.

By operating at lower resolution (typically, mass spectra are obtained at resolutions of between 1 amu and 10 amu), the compact mass spectrometers disclosed herein consume significantly less power than conventional mass spectrometers. For example, the compact mass spectrometers disclosed herein feature miniature ion traps that operate efficiently at pressures from 100 mTorr to 100 Torr to separate ions of different mass-to-charge ratio, while at the same time consuming far less power than conventional mass analyzers such as ion traps due to their reduced size. For example, as the size of a cylindrical ion trap decreases, the maximum voltage applied to the trap to separate ions decreases, and the frequency with which the voltage is applied increases. As a result, the size of inductors and/or resonators used in power supply circuitry is reduced, and the sizes and power consumption requirements of other components used to generate the maximum voltage are also reduced.

Further, the compact mass spectrometers disclosed herein feature efficient ion sources such as glow discharge ionization sources and/or capacitive discharge ionization sources that further reduce power consumption relative to ion sources such as thermionic emitters that are commonly found in conventional mass spectrometers. Efficient, low power detectors such as Faraday detectors are used in the compact mass spectrometers disclosed herein, rather than the more power hungry electron multipliers that are present in conventional mass spectrometers. As a result of these low power components, the compact mass spectrometers disclosed herein operate efficiently and consume relatively small amounts of electrical power. They can be powered by standard battery-based power sources (e.g., Li ion batteries), and are portable with a handheld form factor.

Because they provide high resolution mass spectra directly to the user, conventional mass spectrometers are generally ill-suited for applications that involve mobile scanning of substances by personnel without special training. In particular, for applications such as on-the-spot security scanning in transportation hubs such as airports and train stations, conventional mass spectrometers are impractical solutions. In contrast, such applications instead benefit from mass spectrometers that are compact, require relatively low power to operate, and provide information that can readily be interpreted by personnel without advanced training, as described above. Compact, low cost mass spectrometers are also useful for a variety of other applications. For example, such devices can be used in laboratories to provide rapid characterization of unknown chemical compounds. Due to their low cost and tiny footprint, laboratories can provide workers with personal spectrometers, reducing or eliminating the need to schedule analysis time at a centralized mass spectrometry facility. Compact mass spectrometers can also be used for applications such as medical diagnostics testing, both in clinical settings and in residences of individual patients. Technicians performing such testing can readily interpret the information provided by such spectrometers to provide real-time feedback to patients, and also to provide rapidly updated information to medical facilities, physicians, and other health care providers.

This disclosure features compact, low power mass spectrometers that provide a variety of information to users including identification of chemical substances scanned by the spectrometers and/or associated contextual information, including information about a class to which substances belong (e.g., acids, bases, strong oxidizers, explosives, nitrated compounds), information about hazards associated with the substances, and safety instructions and/or information. The spectrometers operate at internal gas pressures that are higher than conventional mass spectrometers. By operating at higher pressures, the size and power consumption of the compact mass spectrometers is significantly reduced relative to conventional mass spectrometers. Moreover, even though the spectrometers operate at higher pressures, the resolution of the spectrometers is sufficient to permit accurate identification and quantification of a wide variety of chemical substances.

FIG. 1A is a schematic diagram of an embodiment of a compact mass spectrometer 100. Spectrometer 100 includes an ion source 102, an ion trap 104, a voltage source 106, a controller 108, a detector 118, a pressure regulation subsystem 120, and a sample inlet 124. Sample inlet 124 includes a valve 129. Optionally included in spectrometer 100 is a buffer gas source 150. The components of spectrometer 100 are enclosed within a housing 122. Controller 108 includes an electronic processor 110, a user interface 112, a storage unit 114, a display 116, and a communication interface 117.

Controller 108 is connected to ion source 102, ion trap 104, detector 118, pressure regulation subsystem 120, voltage source 106, valve 129, and optional buffer gas source 150 via control lines 127*a*-127*g*, respectively. Control lines 127*a*-127*g* permit controller 108 (e.g., electronic processor 110 in controller 108) to issue operating commands to each of the components to which it is connected. Such commands can include, for example, signals that activate ion source 102, ion trap 104, detector 118, pressure regulation subsystem 120, valve 129, and buffer gas source 150. Commands that activate the various components of spectrometer 100 can include instructions to voltage source 106 to apply electrical potentials to elements of the components. For example, to activate ion source 102, controller 108 can transmit instructions to voltage source 106 to apply electrical potentials to electrodes in ion source 102. As another example, to activate ion trap 104, controller 108 can transmit instructions to voltage source 106 to apply electrical potentials to electrodes in ion trap 104. As a further example, to activate detector 118, controller 108 can transmit instructions to voltage source 106 to apply electrical potentials to detection elements in detector 118. Controller 108 can also transmit signals to activate pressure regulation subsystem 120 (e.g., through voltage source 106) to control the gas pressure in the various components of spectrometer 100, and to valve 129 (e.g., through voltage source 106) to allow gas particles to enter spectrometer 100 through sample inlet 124.

Further, controller 108 can receive signals from each of the components of spectrometer 100 through control lines 127*a*-127*g*. For example, such signals can include information about the operational characteristics of ion source 102 and/or ion trap 104 and/or detector 118 and/or pressure regulation subsystem 120. Controller 108 can also receive information about ions detected by detector 118. The information can include ion currents measured by detector 118, which are related to abundances of ions with specific mass-to-charge ratios. The information can also include information about specific voltages applied to electrodes of ion trap 104 as particular ion abundances are measured by detector 118. The specific applied voltages are related to specific values of mass-to-charge ratio for the ions. By correlating the voltage information with the measured abundance information, controller 108 can determine abundances of ions as a function of mass-to-charge ratio, and can present this information using display 116 in the form of mass spectra.

Voltage source 106 is connected to ion source 102, ion trap 104, detector 118, pressure regulation subsystem 120, and controller 108 via control lines 126*a*-*e*, respectively. Voltage source 106 provides electrical potentials and electrical power to each of these components through control lines 126*a*-*e*. Voltage source 106 establishes a reference potential that corresponds to an electrical ground at a relative voltage of 0 Volts. Potentials applied by voltage source 106 to the various components of spectrometer 100 are referenced to this ground potential. In general, voltage source 106 is configured to apply potentials that are positive and potentials that are negative, relative to the reference ground potential, to the components of spectrometer 100. By applying potentials of different signs to these components (e.g., to the electrodes of the components), electric fields of different signs can be generated within the components, which cause ions to move in different directions. Thus, by applying suitable potentials to the components of spectrometer 100, controller 108 (through voltage source 106) can control the movement of ions within spectrometer 100.

Ion source 102, ion trap 104, and detector 118 are connected such that an internal pathway for gas particles and ions, gas path 128, extends between these components. Sample inlet 124 and pressure regulation subsystem 120 are also connected to gas path 128. Optional buffer gas source 150, if present, is connected to gas path 128 as well. Portions of gas path 128 are shown schematically in FIG. 1A. In general, gas particles and ions can move in any direction in gas path 128, and the direction of movement can be controlled by the configuration of spectrometer 100. For example, by applying suitable electrical potentials to electrodes in ion source 102 and ion trap 104, ions generated in ion source 102 can be directed to flow from ion source 102 into ion trap 104.

Figure 1B:
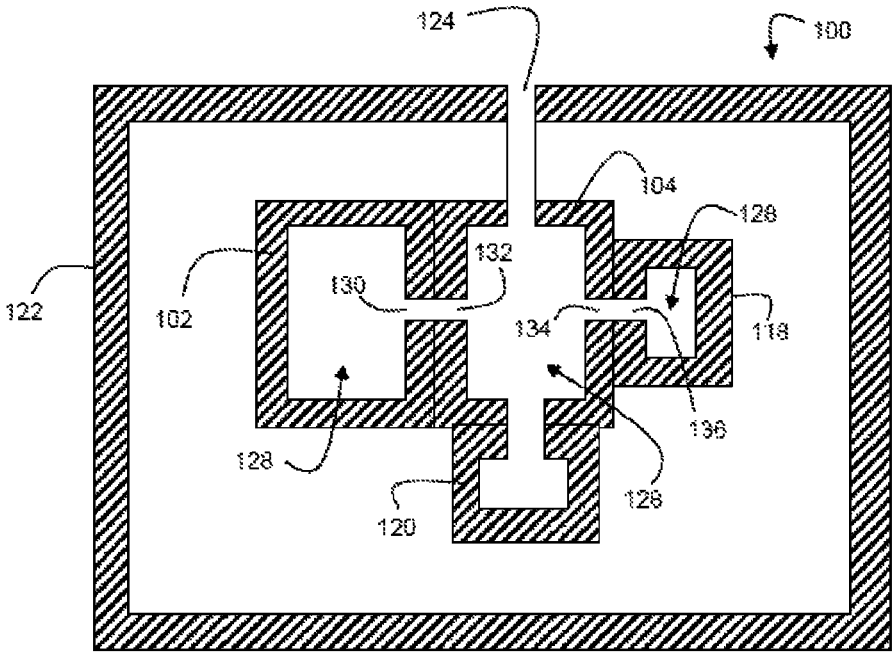
FIG. 1B is a cross-sectional diagram of an embodiment of a mass spectrometer.

FIG. 1B shows a partial cross-sectional diagram of mass spectrometer 100. As shown in FIG. 1B, an output aperture 130 of ion source 102 is coupled to an input aperture 132 of ion trap 104. Further, an output aperture 134 of ion trap 104 is coupled to an input aperture 136 of detector 118. As a result, ions and gas particles can flow in any direction between ion source 102, ion trap 104, and detector 118. During operation of spectrometer 100, pressure regulation subsystem 120 operates to reduce the gas pressure in gas path 128 to a value that is less than atmospheric pressure. As a result, gas particles to be analyzed enter sample inlet 124 from the environment surrounding spectrometer 100 (e.g., the environment outside housing 122) and move into gas path 128. Gas particles that enter ion source 102 through gas path 128 are ionized by ion source 102. The ions propagate from ion source 102 into ion trap 104, where they are trapped by electrical fields created when voltage source 106 applies suitable electrical potentials to the electrodes of ion trap 104.

The trapped ions circulate within ion trap 104. To analyze the circulating ions, voltage source 106, under the control of controller 108, varies the amplitude of a radiofrequency trapping field applied to one or more electrodes of ion trap 104. The variation of the amplitude occurs repetitively, defining a sweep frequency for ion trap 104. As the amplitude of the field is varied, ions with specific mass-to-charge ratios fall out of orbit and some are ejected from ion trap 104. The ejected ions are detected by detector 118, and information about the detected ions (e.g., measured ion currents from detector 118, and specific voltages that are applied to ion trap 104 when particular ion currents are measured) is transmitted to controller 108.

Figure 1C:
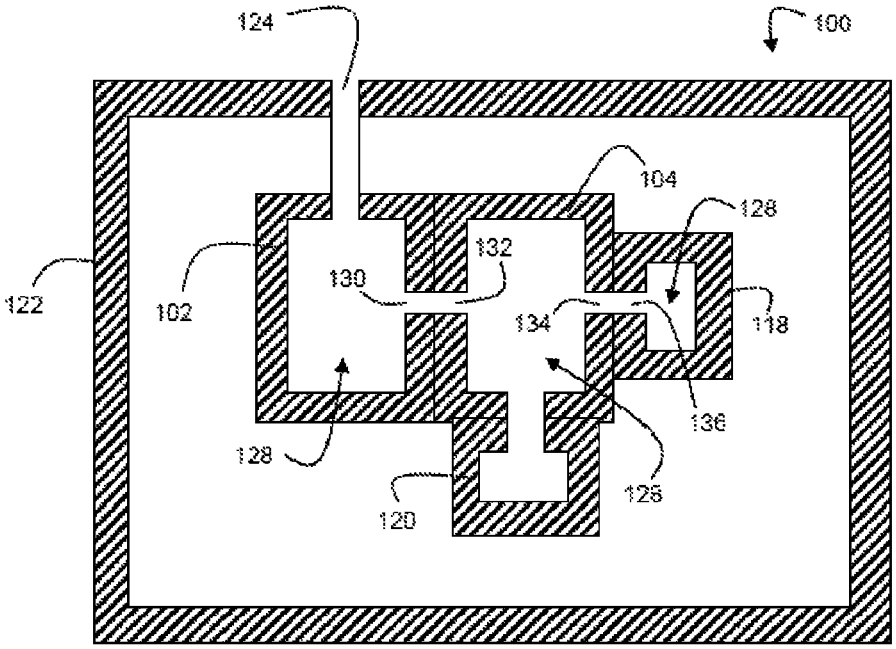
FIG. 1C is a cross-sectional diagram of another embodiment of a mass spectrometer.

Although sample inlet 124 is positioned in FIGS. 1A and 1B so that gas particles enter ion trap 104 from the environment outside housing 122, more generally sample inlet 124 can also be positioned at other locations. For example, FIG. 1C shows a partial cross-sectional diagram of spectrometer 100 in which sample inlet 124 is positioned so that gas particles enter ion source 102 from the environment outside housing 122. In addition to the configuration shown in FIG. 1C, sample inlet 124 can generally be positioned at any location along gas path 128, provided that the position of sample inlet 124 allows gas particles to enter gas path 128 from the environment outside housing 122.

Communication interface 117 can, in general, be a wired or wireless communication interface (or both). Through communication interface 117, controller 108 can be configured to communicate with a wide variety of devices, including remote computers, mobile phones, and monitoring and security scanners. Communication interface 117 can be configured to transmit and receive data over a variety of networks, including but not limited to Ethernet networks, wireless WiFi networks, cellular networks, and Bluetooth wireless networks. Controller 108 can communicate with remote devices using communication interface 117 to obtain a variety of information, including operating and configuration settings for spectrometer 100, and information relating to substances of interest, including records of mass spectra of known substances, hazards associated with particular substances, classes of compounds to which substances of interest belong, and/or spectral features of known substances. This information can be used by controller 108 to analyze sample measurements. Controller 108 can also transmit information to remote devices, including alerting messages when certain substances (e.g., hazardous and/or explosive substances) are detected by spectrometer 100.

The mass spectrometers disclosed herein are both compact and capable of low power operation. To achieve both compact size and low power operation, the various spectrometer components, including ion source 102, ion trap 104, detector 118, pressure regulation subsystem 120, and voltage source 106, are carefully designed and configured to minimize space requirements and power consumption. In conventional mass spectrometers, the vacuum pumps used to achieve low internal operating pressures (e.g., $1\times10^{-3}$ Torr or considerably less) are both large and consume significant amounts of electrical power. For example, to reach such pressures, conventional mass spectrometers typically employ a series of two or more pumps, including a rough pump that rapidly reduces the internal system pressure from atmospheric pressure to about 0.1-10 Torr, and one or more turbomolecular pumps that reduce the internal system pressure from 10 Torr to the desired internal operating pressure. Both rough pumps and turbomolecular pumps are mechanical pumps that require significant quantities of electrical power to run. Rough pumps (which can include, for example, piston-based pumps) typically generate significant mechanical vibrations. Turbomolecular pumps are typically sensitive to both vibrations and mechanical shocks, and produce effects that are similar to a gyroscope due to their high rotational speeds. As a result, conventional mass spectrometers include power sources sufficient to meet the consumption requirements of their vacuum pumps, and isolation mechanisms (e.g., vibrational and/or rotational isolation mechanisms) to ensure that these pumps remain operating. Conventional mass spectrometers may even require that while operating, the turbomolecular pumps therein cannot be moved, as doing so may result in mechanical vibrations that would destroy these pumps. As a result, the combination of vacuum pumps and electrical power sources used in conventional mass spectrometers makes them large, heavy, and immobile.

In contrast, the mass spectrometer systems and methods disclosed herein are compact, mobile, and achieve low power operation. These characteristics are realized in part by eliminating the turbomolecular, rough, and other large mechanical pumps that are common to conventional spectrometers. In place of these large pumps, small, low power single mechanical pumps are used to control gas pressure within the mass spectrometer systems. The single mechanical pumps used in the mass spectrometer systems disclosed herein cannot reach pressures as low as conventional turbomolecular pumps. As a result, the systems disclosed herein operate at higher internal gas pressures than conventional mass spectrometers.

As will be explained in greater detail below, operating at higher pressure generally degrades the resolution of a mass spectrometer, due to a variety of mechanisms such as collision-induced line broadening and charge exchange among molecular fragments. As used herein, "resolution" is defined as the full width at half-maximum (FWHM) of a measured mass peak. The resolution of a particular mass spectrometer is determined by measuring the FWHM for all peaks that appear within the range of mass-to-charge ratios from 100 to 125 amu, and selecting the largest FWHM that corresponds to a single peak (e.g., peak widths that correspond to closely spaced sets of two or more peaks are excluded) as the resolution. To determine the resolution, a chemical substance with a well known mass spectrum, such as toluene, can be used.

While the resolution of a mass spectrometer may be degraded when operating at higher pressures, the mass spectrometers disclosed herein are configured so that reduced resolution does not compromise the usefulness of the spectrometers. Specifically, the mass spectrometers disclosed herein are configured so that when a chemical substance of interest is scanned using a spectrometer, the spectrometer reports to the user information relating to an identity of the substance, rather than a mass-resolved spectrum of molecular ions, as is common in conventional mass spectrometers. In some embodiments, the algorithms used in the mass spectrometers disclosed herein can compare measured ion fragmentation patterns to information about known fragmentation patterns to determine information such as an identity of the substance of interest, hazard information relating to the substance of interest, and/or one or more classes of compounds to which the substance of interest belongs. In certain embodiments, the algorithms can include expert systems to determine information about the identity of the substance of interest. For example, digital filters can be used to search for particular features in measured spectra for a substance of interest, and the substance can be identified as corresponding to a particular target substance or not corresponding to the target substance based on the presence or absence of the features in the spectra.

When controller 108 performs the foregoing analyses, reduced resolution due to operation at high pressure can be compensated for by the systems disclosed herein. That is, provided a reliable correspondence between a measured fragmentation pattern and reference information can be achieved, the lower resolution due to high pressure operation is of little consequence to users of the mass spectrometers disclosed herein. Thus, even though the mass spectrometers disclosed herein operate at higher pressures than conventional mass spectrometers, they remain useful for a wide variety of applications such as security scanning, medical diagnostics, and laboratory analysis, in which the user is primarily concerned with identifying a substance of interest rather than examining the substance's ion fragmentation pattern in detail, and where the user may not have advanced training in the interpretation of mass spectra.

By using a single, small mechanical pump, the weight, size, and power consumption of the mass spectrometers disclosed herein is substantially reduced relative to conventional mass spectrometers. Thus, the mass spectrometers disclosed herein generally include pressure regulation subsystem 120, which features a small mechanical pump, and which is configured to maintain an internal gas pressure (e.g., a gas pressure in gas path 128, and in ion source 102, ion trap 104, and detector 118, all of which are connected to gas path 128) of between 100 mTorr and 100 Torr (e.g., between 100 mTorr and 500 mTorr, between 500 mTorr and 100 Torr, between 500 mTorr and 10 Torr, between 500 mTorr and 5 Torr, between 100 mTorr and 1 Torr). In some embodiments, the pressure regulation subsystem is configured to maintain an internal gas pressure in the mass spectrometers disclosed herein of more than 100 mTorr (e.g., more than 500 mTorr, more than 1 Torr, more than 10 Torr, more than 20 Torr).

At the foregoing pressures, the mass spectrometers disclosed herein detect ions at a resolution of 10 amu or better. For example, in some embodiments, the resolution of the mass spectrometers disclosed herein, measured as described above, is 10 amu or better (e.g., 8 amu or better, 6 amu or better, 5 amu or better, 4 amu or better, 3 amu or better, 2 amu or better, 1 amu or better). In general, any of these resolutions can be achieved at any of the foregoing pressures using the mass spectrometers disclosed herein.

In addition to a pump, pressure regulation subsystem 120 can include a variety of other components. In some embodiments, pressure regulation subsystem 120 includes one or more pressure sensors. The one or more pressure sensors can be configured to measure gas pressure in a fluid conduit to which pressure regulation subsystem 120 is connected, e.g., gas path 128. Measurements of gas pressure can be transmitted to a pump within pressure regulation subsystem 120, and/or to controller 108, and can be displayed on display 116. In certain embodiments, pressure regulation subsystem 120 can include other elements for fluid handling such as one or more valves, apertures, sealing members, and/or fluid conduits.

To ensure that the pressure regulation subsystem functions efficiently to control the internal pressure in the mass spectrometers disclosed herein, the internal volume of the spectrometers (e.g., the volume that is pumped by the pressure regulation subsystem) is significantly reduced relative to the internal volume of conventional mass spectrometers. Reducing the internal volume has the added benefit of reducing the overall size of the mass spectrometers disclosed herein, making them compact, portable, and capable of one-handed operation by a user.

As shown in FIGS. 1B and 1C, the internal volume of the mass spectrometers disclosed herein includes the internal volumes of ion source 102, ion trap 104, and detector 118, and regions between these components. More generally, the internal volume of the mass spectrometers disclosed herein corresponds to the volume of gas path 128—that is, the volumes of all of the connected spaces within mass spectrometer 100 where gas particles and ions can circulate. In some embodiments, the internal volume of mass spectrometer 100 is 10 $cm^3$ or less (e.g., 7.0 $cm^3$ or less, 5.0 $cm^3$ or less, 4.0 $cm^3$ or less, 3.0 $cm^3$ or less, 2.5 $cm^3$ or less, 2.0 $cm^3$ or less, 1.5 $cm^3$ or less, 1.0 $cm^3$ or less).

Figure 1D:
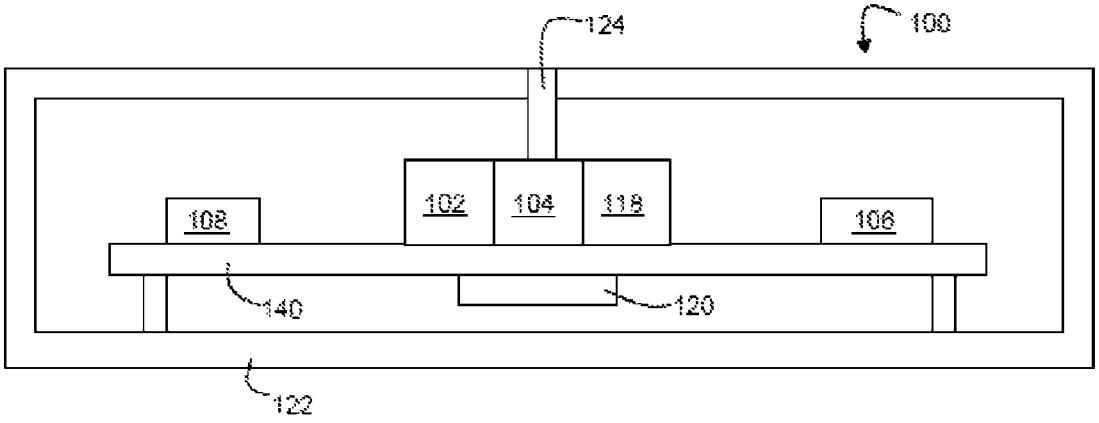
FIG. 1D is a schematic diagram of a mass spectrometer with components mounted to a support base.

In some embodiments, the mass spectrometers disclosed herein are fully integrated on a single support base. FIG. 1D is a schematic diagram of an embodiment of mass spectrometer 100 in which all of the components of spectrometer 100 are integrated onto a single support base 140. As shown in FIG. 1D, ion source 102, ion trap 104, detector 118, controller 108, and voltage source 106 are each mounted to, and electrically connected to, support base 140. Support base 140 can be, for example, a printed circuit board, and can include control lines that extend between the components of spectrometer 100. Thus, for example, voltage source 106 provides electrical power to ion source 102, ion trap 104, detector 118, controller 108, and pressure regulation subsystem 120 through control lines (e.g., control lines 126*a-e*) integrated into support base 140. Further, ion source 102, ion trap 104, detector 118, pressure regulation subsystem 120, and voltage source 106 are each connected to controller 108 through control lines (e.g., control lines 127*a-e*) integrated into support base 140, so that controller 108 can send and receive electrical signals to each of these components through support base 140.

Integration on a single support base such as a printed circuit board provides a number of important advantages. Support base 140 provides a stable platform for the components of spectrometer 100, ensuring that each of the components is mounted stably and securely, and reducing the likelihood that components will be damaged during rough handling of spectrometer 100. In addition, mounting all components on a single support base simplifies manufacturing of spectrometer 100, as support base 140 provides a reproducible template for the positioning and connection of the various components to one another. Further, by integrating all of the control lines onto the support base, such that both electrical power and control signals are transmitted between components through support base 140, the integrity of the electrical connections between components can be maintained—such connections are less susceptible to wear and/or breakage than connections formed by individual wires extending between components.

Further, by integrating the components of spectrometer 100 onto a single support base, spectrometer 100 has a compact form factor. In particular, a maximum dimension of support base 140 (e.g., a largest linear distance between any two points on support base 140) can be 25 cm or less (e.g., 20 cm or less, 15 cm or less, 10 cm or less, 8 cm or less, 7 cm or less, 6 cm or less).

As shown in FIG. 1D, support base 140 is mounted to housing 122 using mounting pins 145. In some embodiments, mounting pins 145 are designed to insulate support base 140 (and the components mounted to support base 140) from mechanical shocks. For example, mounting pins 145 can include shock absorbing materials (e.g., compliant materials such as soft rubber) to insulate support base 140 against mechanical shocks. As another example, grommets or spacers formed from shock absorbing materials can be positioned between support base 140 and housing 122 to insulate support base 140 against mechanical shocks.

Figure 1E:
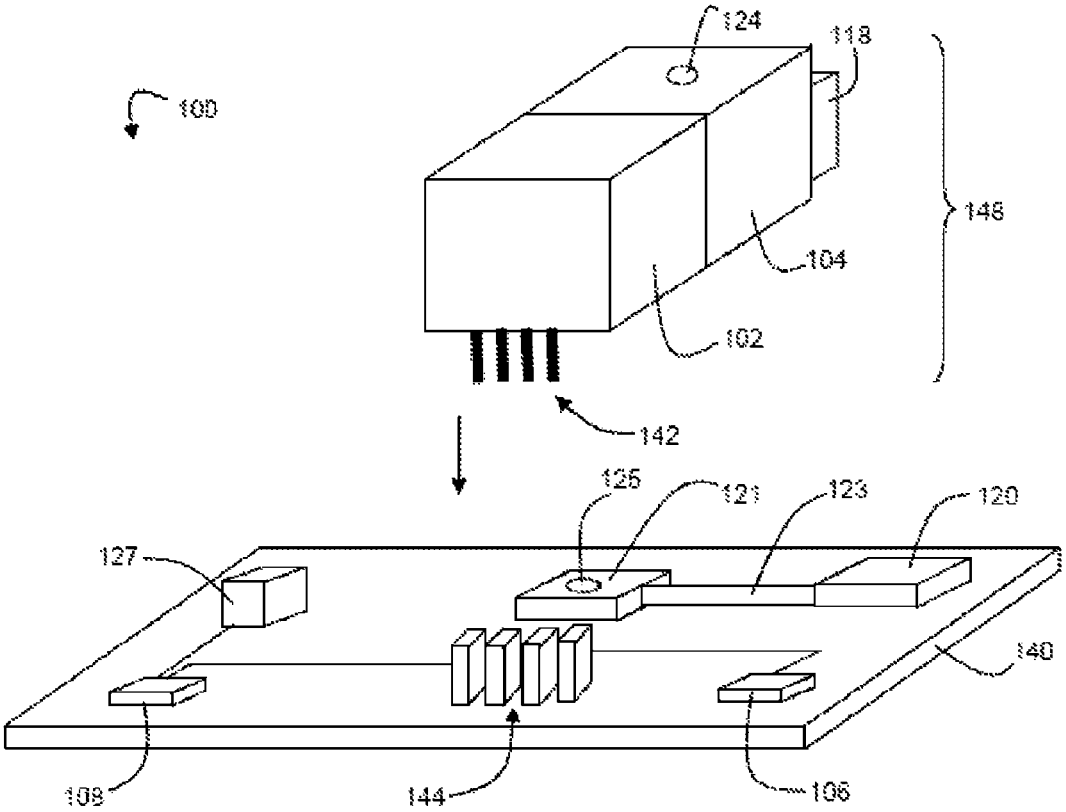
FIG. 1E is a schematic diagram of a mass spectrometer with a pluggable module.

In some embodiments, the mass spectrometers disclosed herein include a pluggable, replaceable module in which multiple system components are integrated. FIG. 1E is a schematic diagram of an embodiment of mass spectrometer 100 that includes a pluggable, replaceable module 148 and a support base 140 configured to receive module 148. Ion source 102, ion trap 104, detector 118, and sample inlet 124 are each integrated into module 148.

Module 148 also includes a plurality of electrodes 142 that extend outward from the module. Within module 148, electrodes 142 are connected to each of the components within the module, e.g., to ion source 102, ion trap 104, and detector 118.

Also shown in FIG. 1E is a support base 140 (e.g., a printed circuit board) on which controller 108, voltage source 106, and pressure regulation subsystem 120 are mounted. Support base 140 includes a plurality of electrodes 144 that are configured to releasably engage and disengage electrodes 142 of module 148. In some embodiments, for example, electrodes 142 are pins, and electrodes 144 are sockets configured to receive electrodes 142. Alternatively, electrodes 144 can be pins, and electrodes 142 can be sockets configured to receive the pins. Module 148 can be connected to support base 140 by applying a force in the direction shown by the arrow in FIG. 1E with electrodes 142 of module 148 aligned with corresponding electrodes 144 of support base, so that module 148 can be releasably connected to, or disconnected from, support base 140. Module 148 can be disengaged from support base 140 by applying a force in a direction opposite to the arrow.

Electrodes 144 of support base 140 are connected to controller 108 and voltage source 106, as shown in FIG. 1E. When a connection is established between electrodes 142 and electrodes 144, controller 108 can send and receive signals to/from each of the components integrated within module 148, as discussed above in connection with control lines 127. Further, voltage source 106 can provide electrical power to each of the components integrated within module 148, as discussed above in connection with control lines 126

Pressure regulation subsystem 120, which is mounted to support base 140, is connected to a manifold 121 via conduit 123 Manifold 121, which includes one or more apertures 125, is positioned on support base 140 so that when module 148 is connected to support base 140, a sealed fluid connection is established between manifold 121 and module 148. In particular, a fluid connection is established between apertures 125 in manifold 121 and corresponding apertures in module 148 (not shown in FIG. 1E). The apertures in module 148 can be formed in the walls of ion source 102, ion trap 104, and/or detector 118. When the sealed fluid connection is established, pressure regulation subsystem 120 can control gas pressure within the components of module 148 by pumping gas particles out of the module through manifold 121.

Other configurations of module 148 are also possible. In some embodiments, for example, detector 118 is not part of module 148, and is instead mounted to support base 140. In such a configuration, detector 118 is positioned on support base 140 so that when module 148 is connected to support base 140, a sealed fluid connection is established between ion trap 104 and detector 118. Establishing a sealed fluid connection allows circulating ions within ion trap 104 to be ejected from the trap and detected using detector 118, and also allows pressure regulation subsystem 120 to maintain reduced gas pressure (e.g., between 100 mTorr and 100 Torr) in detector 118.

In certain embodiments, pressure regulation subsystem 120 can be integrated into module 148. For example, pressure regulation subsystem 120 can be attached to the underside of ion trap 104 and connected directly to gas path 128 within module 148. Pressure regulation subsystem 120 is also electrically connected to electrodes 142 of module 148. When module 148 is connected to support base 140, pressure regulation subsystem 120 can transmit and receive electrical signals to/from controller 108 and voltage source 106 through electrodes 142.

The modular configuration of mass spectrometer 100 shown in FIG. 1E provides a number of advantages. For example, during operation of mass spectrometer 100, certain components can become contaminated with analyte residues. For example, analyte residues can adhere to the walls of the ion trap 104, reducing the efficiency with which ion trap 104 can separate ions, and contaminating analyses of other substances. By integrating ion trap 104 within module 148, the entire module 148 can be replaced easily and rapidly if ion trap 104 is contaminated, ensuring that mass spectrometer 100 can quickly be returned to operational status in the field even by an untrained user. Similarly, if either ion source 102 or detector 118 becomes contaminated or undergoes failure, module 148 can easily be replaced by a user of spectrometer 100 to return spectrometer 100 to operation.

The modular configuration shown in FIG. 1E also ensures that spectrometer 100 remains compact and portable. In some embodiments, for example, a maximum dimension of module 148 (e.g., a maximum linear distance between any two points on module 148) is 10 cm or less (e.g., 9 cm or less, 8 cm or less, 7 cm or less, 6 cm or less, 5 cm or less, 4 cm or less, 3 cm or less, 2 cm or less, 1 cm or less).

A module 148 with reduced functionality (e.g., a module that has become contaminated with analyte particles that adhere to interior walls of ion source 102, ion trap 104, and/or detector 118) can be regenerated and returned to use. In some embodiments, to return a module 148 to normal operation, the module can be heated while it is installed within spectrometer 100. Heating can be accomplished using a heating element 127 mounted on support base 140. As shown in FIG. 1E, heating element 127 is positioned on support base 140 so that when module 148 is connected to support base 140, heating element 127 contacts one or more of the components of module 148 (e.g., ion source 102, ion trap 104, and detector 118).

Controller 108 can be configured to activate heating element 127 by directing voltage source 106 to apply suitable electrical potentials to heating element 127. Commencement of heating, and the temperature and duration of heating, can be controlled by a user of spectrometer 100, e.g., by activating a control on display 116 and/or by entering user configuration settings into storage unit 114. In certain embodiments, controller 108 can be configured to determine automatically when regeneration of module 148 is appropriate. For example, controller 108 can monitor detected ion currents over a period of time, and if the ion current falls by more than a threshold amount (e.g., 25% or more, 50% or more, 60% or more, 70% or more) within a particular time period (e.g., 1 hour or more, 5 hours or more, 10 hours or more, 24 hours or more, 2 days or more, 5 days or more, 10 days or more), then controller 108 determines that regeneration of module 148 is needed.

Although heating element 127 is mounted on support base 140 in FIG. 1E, other configurations are also possible. In some embodiments, for example, heating element 147 is part of module 148, and can be attached so that it directly contacts some or all of the components of module 148 (e.g., ion source 102, ion trap 104, and detector 118).

In certain embodiments, module 148 can be removed from spectrometer 100 for regeneration. For example, when module 148 exhibits reduced functionality (e.g., as determined by a user of spectrometer 100, or as determined automatically by controller 108 using the above criteria), module 148 can be removed from spectrometer 100 and heated to restore it to normal operating condition. Heating can be accomplished in a variety of ways, including heating in general purpose ovens. In some embodiments, spectrometer 100 can include a dedicated plug-in heater that includes a slot configured to receive module 148. When a module is inserted into the slot and the heater is activated, the module is heated to restore its functionality.

While ion source 102, ion trap 104, and detector 118 are generally configured to detect and identify a wide variety of chemical substances, in certain embodiments these components can be specifically tailored for detection of certain classes of substances. In some embodiments, ion source 102 can be specifically configured for use with certain substances. For example, different electrical potentials can be applied to the electrodes of ion source 102 to generate either positive or negative ions from gas particles. Further, the magnitudes of the electrical potentials applied to the electrodes of ion source 102 can be varied to control the efficiency with which certain substances ionize. In general, different substances have different affinities for ionization depending upon their chemical structure. By adjusting the polarity and the electrical potential difference between electrodes of ion source 102, ionization of a variety of substances can be carefully controlled.

In certain embodiments, ion trap 104 can be specifically configured for use with certain substances. For example, the internal dimensions (e.g., the internal diameter) of ion trap 104 can be selected to favor trapping and detection of ions with higher mass-to-charge ratio.

In some embodiments, internal gas pressures within one or more of ion source 102, ion trap 104, and detector 118 can be selected to favor softer or harder ionization mechanisms, or positive or negative ion generation. Further, the magnitudes and polarities of the electrical potentials applied to the electrodes of ion source 102 and ion trap 104 can be selected to favor certain ionization mechanisms. As discussed above, different substances have different affinities for ionization, and may ionize more efficiently in one manner (e.g., according to one mechanism) than another. By adjusting the gas pressures and electrical potentials applied to various electrodes within spectrometer 100, the spectrometer can be adapted to specifically detect a wide variety of substances and classes of substances. In addition, by adjusting the geometry of ion trap 104 and/or the electrical potentials applied to its electrodes, the mass window of ion trap 104 (e.g., the range of ion mass-to-charge ratios that can be maintained in circulating orbit within ion trap 104) can be selected.

In certain embodiments, ion source 102 can include a particular type of ionizer tailored for certain types of substances. For examples, ionization sources based on glow discharge ionization, electrospray mass ionization, capacitive discharge ionization, dielectric barrier discharge ionization, and any of the other ionizer types disclosed herein can be used in ion source 102.

In some embodiments, detector 118 can be specifically tailored for certain types of detection tasks. For example, detector 118 can any one or more of the detectors disclosed herein. The detectors can be arranged in specific configurations, e.g., in array form, with a plurality of detection elements such as a plurality of Faraday cup detectors, as will be discussed subsequently, and/or in any arrangement within detector 118. In addition to being tailored for detection of certain substances, detector 118 can also be tailored for use with certain types of ion sources and ion traps. For example, the arrangement and types of detection elements within detector 118 can be selected to correspond to the arrangement of ion chambers within ion trap 104, particularly where ion trap 104 includes multiple ion chambers.

In certain embodiments, one or more internal surfaces of module 148 (e.g., of ion source 102 and/or ion trap 104 and/or detector 118) can include one or more coatings and/or surface treatments. The coatings and/or surface treatments can be adapted for specific applications, including detection of specific types of substances, operation within specific gas pressure ranges, and/or operation at certain applied electrical potentials. Examples of coatings and surface treatments that can be used to tailor module 148 for specific substances and/or applications include Teflon® (more generally, fluorinated polymer coatings), anodized surfaces, nickel, and chrome.

Other components of module 148 can also be adapted to detect specific substances or classes of substances. For example, sample inlet 124 can be equipped with a filter that is configured to selectively allow only certain classes of substances to pass into spectrometer 100, or similarly, delay the passage of certain materials into the spectrometer compared to the passage of others. In some embodiments, for example, the filter can include a HEPA filter (or a similar type of filter) that removes solid, micron-sized particles such as dust particles from the flow of gas particles that enters sample inlet 124. In certain embodiments, the filter can include a molecular sieve-based filter that removes water vapor from the flow of gas particles that enters sample inlet 124. Both of these types of filters do not filter atmospheric gas particles (e.g., nitrogen molecules and oxygen molecules), and instead allow atmospheric gas particles to pass through and enter gas path 128 of spectrometer 100. Where this disclosure refers to a filter that does not remove or filter atmospheric gas particles, it is to be understood that the filter allows at least 95% or more of the atmospheric gas particles that encounter the filter to pass through.

Accordingly, in some embodiments, mass spectrometer 100 can include multiple replaceable modules 148. Some of the modules can be the same, and can function as direct replacements for one another (e.g., in the event of contamination). Other modules can be configured for different modes of operation. For example, the multiple replaceable modules 148 can be configured to detect different classes of substances. A user operating spectrometer 100 can select a suitable module for a particular class of substances, and can plug in the selected module to support base 140 prior to initiating an analysis. To analyze a different class of substances, the user can disengage the first module from support base 140, select a new module, and plug in the new module to support base 140. As a result, re-configuring the components of mass spectrometer 100 for a variety of different applications is rapid and straightforward. Modules can also be specifically configured to different types of measurements (e.g., using different ionization methods, different trapping and/or ejection potentials applied to the electrodes of ion trap 104, and/or different detection methods). In general, each of the multiple replaceable modules 148 can include any of the features disclosed herein. Thus, some of the modules can differ based on their ion sources, some of the modules can differ based on their ion traps, and some of the modules can differ based on their detectors. Certain modules may differ from one another based on more than one of these components.

In the following sections, the various components of mass spectrometer 100 will be discussed in greater detail, and various operating modes of spectrometer 100 will also be discussed.

II. Ion Source

In general, ion source 102 is configured to generate electrons and/or ions. Where ion source 102 generates ions directly from gas particles that are to be analyzed, the ions are then transported from ion source 102 to ion trap 104 by suitable electrical potentials applied to the electrodes of ion source 102 and ion trap 104. Depending upon the magnitude and polarity of the potentials applied to the electrodes of ion source 102 and the chemical structure of the gas particles to be analyzed, the ions generated by ion source 102 can be positive or negative ions. In some embodiments, electrons and/or ions generated by ion source 102 can collide with neutral gas particles to be analyzed to generate ions from the gas particles. During operation of ion source 102, a variety of ionization mechanisms can occur at the same time within ion source 102, depending upon the chemical structure of the gas particles to be analyzed and the operating parameters of ion source 102.

By operating at higher internal gas pressures than conventional mass spectrometers, the compact mass spectrometers disclosed herein can use a variety of ion sources. In particular, ion sources that are small and that require relatively modest amounts of electrical power to operate can be used in spectrometer 100. In some embodiments, for example, ion source 102 can be a glow discharge ionization (GDI) source. In certain embodiments, ion source 102 can be a capacitive discharge ion source.

A variety of other types of ion sources can also be used in spectrometer 100, depending upon the amount of power required for operation and their size. For example, other ion sources suitable for use in spectrometer 100 include dielectric barrier discharge ion sources and thermionic emission sources. As a further example, ion sources based on electrospray ionization (ESI) can be used in spectrometer 100. Such sources can include, but are not limited to, sources that employ desorption electrospray ionization (DESI), secondary ion electrospray ionization (SESI), extractive electrospray ionization (EESI), and paper spray ionization (PSI). As yet another example, ion sources based on laser desorption ionization (LDI) can be used in spectrometer 100. Such sources can include, but are not limited to, sources that employ electrospray-assisted laser desorption ionization (ELDI), and matrix-assisted laser desorption ionization (MALDI). Still further, ion sources based on techniques such as atmospheric solid analysis probe (ASAP), desorption atmospheric pressure chemical ionization (DAPCI), desorption atmospheric pressure photoionization (DAPPI), and sonic spray ionization (SSI) can be used in spectrometer 100. Ion sources based on arrays of nanofibers (e.g., arrays of carbon nanofibers) are also suitable for use. Other aspects and features of the foregoing ion sources, and other examples of ion sources suitable for use in spectrometer 100, are disclosed, for example, in the following publications, the entire contents of each of which is incorporated by reference herein: Alberici et al., "Ambient mass spectrometry: bringing MS into the 'real world,'" *Anal. Bioanal. Chem.* 398: 265-294 (2010); Harris et al. "Ambient Sampling/Ion Mass Spectrometry: Applications and Current Trends," *Anal. Chem.* 83: 4508-4538 (2011); and Chen et al., "A Micro Ionizer for Portable Mass Spectrometers using Double-gated Isolated Vertically Aligned Carbon Nanofiber Arrays," *IEEE Trans. Electron Devices* 58(7): 2149-2158 (2011).

GDI sources are particularly advantageous for use in spectrometer 100 because they are compact and well suited for low power operation. The glow discharge that occurs when these sources are active occurs only when gas pressures are sufficient, however. Typically, for example, GDI sources are limited in operation to gas pressures of approximately 200 mTorr and above. At pressures lower than 200 mTorr, sustaining a stable glow discharge can be difficult. As a result, GDI sources are not used in conventional mass spectrometers, which operate at pressures of 1 mTorr or less. However, because the mass spectrometers disclosed herein typically operate at gas pressures of between 100 mTorr and 100 Torr, GDI sources can be used.

Figure 2:
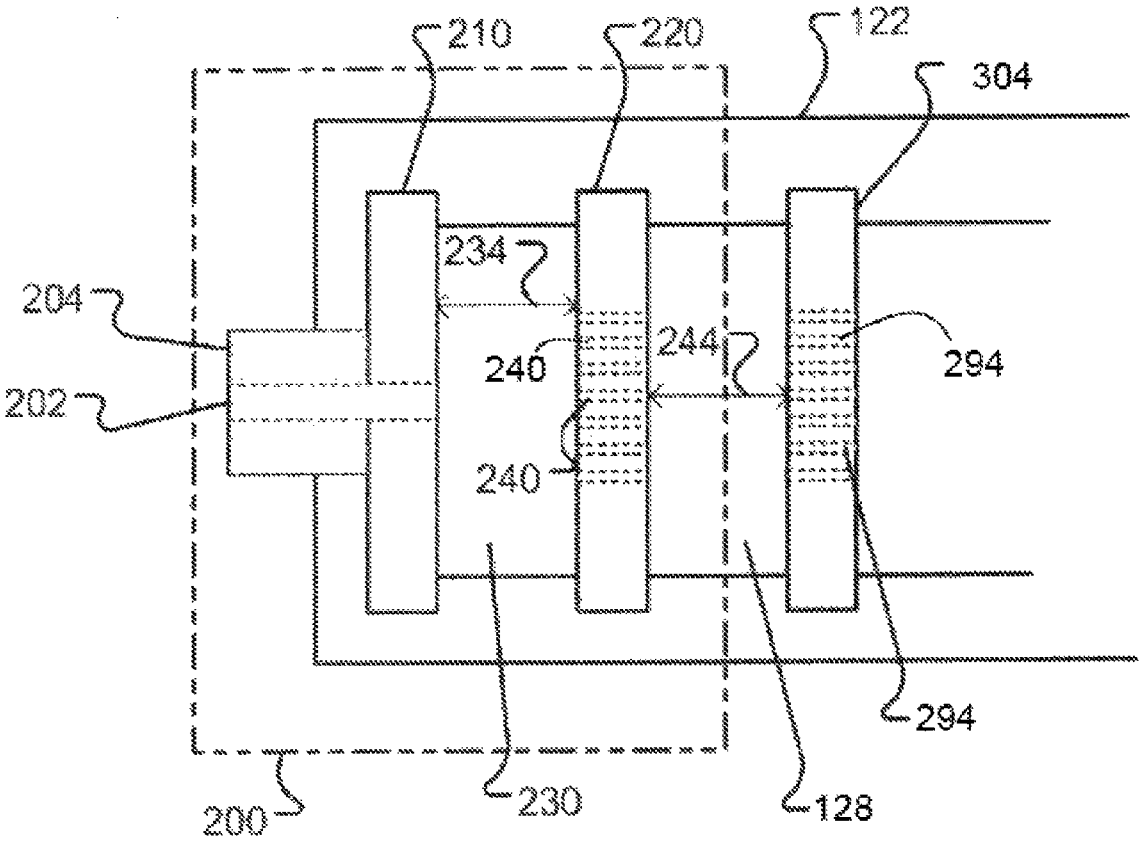
FIG. 2 is a schematic diagram of an ion source.

FIG. 2 shows an example of a GDI source 200 that includes a front electrode 210 and a back electrode 220. The two electrodes 210 and 220, along with the housing 122, form the GDI chamber 230. In some embodiments, GDI source 200 can also include a housing (not shown in FIG. 2) that encloses the electrodes of the source.

As shown in FIG. 2, front electrode 210 has an aperture 202 in which gas particles to be analyzed enter GDI chamber 230. As used herein, the term "gas particles" refers to atoms, molecules, or aggregated molecules of a gas that exist as separate entities in the gaseous state. For example, if the substance to be analyzed is an organic compound, then the gas particles of the substance are individual molecules of the substance in the gas phase.

Aperture 202 is surrounded by an insulating tube 204. In FIG. 2, aperture 202 is connected to sample inlet 124 (not shown), so that gas particles to be analyzed are drawn into GDI chamber 230 due to the pressure difference between the atmosphere external to spectrometer 100 and GDI chamber 230. In addition to gas particles to be analyzed, atmospheric gas particles are also drawn into GDI chamber 230 due to the pressure difference. As used herein, the term "atmospheric gas particles" refers to atoms or molecules of gases in air, such as molecules of oxygen gas and nitrogen gas.

In some embodiments, additional gas particles can be introduced into GDI source 200 to assist in the generation of electrons and/or ions in the source. For example, as explained above in connection with FIG. 1A, spectrometer 100 can include a buffer gas source 150 connected to gas path 128. Buffer gas particles from buffer gas source 150 can be introduced directly into GDI source 200, or can be introduced into another portion of gas path 128 and diffuse into GDI source 200. The buffer gas particles can include nitrogen molecules, and/or noble gas atoms (e.g., He, Ne, Ar, Kr, Xe). Some of the buffer gas particles can be ionized by electrodes 210 and 220.

Alternatively, in some embodiments, a mixture of gas particles that includes the gas particles to be analyzed and atmospheric gas particles are the only gas particles that are introduced into GDI chamber 230. In such embodiments, only the gas particles to be analyzed may be ionized in GDI chamber 230. In certain embodiments, both the gas particles to be analyzed and admitted atmospheric gas particles may be ionized in GDI chamber 230.

Although aperture 202 is positioned in the center of the front electrode 210 in FIG. 2, more generally aperture 202 can be positioned at a variety of locations in GDI source 200. For example, aperture 202 can be positioned in a sidewall of GDI chamber 230, where it is connected to sample inlet 124. Further, as has been described previously, in some embodiments sample inlet 124 can be positioned so that gas particles to be analyzed are drawn directly into another one of the components of spectrometer 100, such as ion trap 104 or detector 118. When the gas particles are drawn into a component other than ion source 102, the gas particles diffuse through gas path 128 and into ion source 102. Alternatively, or in addition, when the gas particles to be analyzed are drawn directly into a component such as ion trap 104, ion source 102 can generate ions and/or electrons which then collide with the gas particles to be analyzed within ion trap 104, generating ions from the gas particles directly inside the ion trap.

Thus, depending upon where the gas particles to be analyzed are introduced intro spectrometer 100 (e.g., the position of sample inlet 124), ions can be generated from the gas particles at a variety of different locations. Ion generation can occur directly in ion source 102, and the generated ions can be transported into ion trap 104 by applying suitable electrical potentials to the electrodes of ion source 102 and ion trap 104. Ion generation can also occur within ion trap 104, when charged particles such as ions (e.g., buffer gas ions) and electrons generated by ion source 102 enter ion trap 104 and collide with gas particles to be analyzed. Ion generation can occur in multiple places at once (e.g., in both ion source 102 and ion trap 104), with all of the generated ions eventually becoming trapped within ion trap 104. Although the discussion in this section focuses largely on direct generation of ions from gas particles of interest within ion source 102, the aspects and features disclosed herein are also applicable generally to the secondary generation of ions from gas particles of interest in other components of spectrometer 100.

A variety of different spacings between electrodes 210 and 220 can be used. In general, the efficiency with which ions are generated is determined by a number of factors, including the potential difference between electrodes 210 and 220, the gas pressure within GDI source 200, the distance 234 between electrodes 210 and 220, and the chemical structure of the gas particles that are ionized. Typically, distance 234 is relatively small to ensure that GDI source 200 remains compact. In some embodiments, for example, distance 234 between electrodes 210 and 220 is be 1.5 cm or less (e.g., 1 cm or less, 0.75 cm or less, 0.5 cm or less, 0.25 cm or less, 0.1 cm or less).

The gas pressure in GDI chamber 230 is generally regulated by pressure regulation subsystem 120. In some embodiments, the gas pressure in GDI chamber 230 is approximately the same as the gas pressure in ion trap 104 and/or detector 118. In certain embodiments, the gas pressure in GDI chamber 230 differs from the gas pressure in ion trap 104 and/or detector 118. Typically, the gas pressure in GDI chamber 230 is 100 Torr or less (e.g., 50 Torr or less, 20 Torr or less, 10 Torr or less, 5 Torr or less, 1 Torr or less, 0.5 Torr or less) and/or 100 mTorr or more (e.g., 200 mTorr or more, 300 mTorr or more, 500 mTorr or more, 1 Torr or more, 10 Torr or more, 20 Torr or more).

During operation, GDI source 200 generates a self-sustaining glow discharge (or plasma) when a voltage difference is applied between front electrode 210 and back electrode 220 by voltage source 106 under the control of controller 108. In some embodiments, the voltage difference can be 200V or higher (e.g., 300V or higher, 400V or higher, 500V or higher, 600V or higher, 700V or higher, 800V or higher) to sustain the glow discharge. As discussed above, detector 118 detects the ions generated by GDI source 200, and the potential difference between electrodes 210 and 220 can be adjusted by controller 108 to control the rate at which ions are generated by GDI source 200.

In some embodiments, GDI source 200 is directly mounted to support base 140, and electrodes 210 and 220 are directly connected to voltage source 106 through support base 140, as shown in FIG. 1D. In certain embodiments, GDI source 200 forms a part of module 148, and electrodes 210 and 220 are connected to electrodes 142 of module 148, as shown in FIG. 1E. When module 148 is plugged into support base 140, electrodes 210 and 220 are connected to voltage source 106 through electrodes 144 that engage electrodes 142.

By applying electrical potentials of differing polarity relative to the ground potential established by voltage source 106. GDI source 200 can be configured to operate in different ionization modes. For example, during typical operation of GDI source 200, a small fraction of gas particles is initially ionized in GDI chamber 230 due to random processes (e.g., thermal collisions). In some embodiments, electrical potentials are applied to front electrode 210 and back electrode 220 such that front electrode 210 serves as the cathode and back electrode 220 serves as the anode. In this configuration, positive ions generated in GDI chamber 230 are driven towards the front electrode 210 due to the electric field within the chamber. Negative ions and electrons are driven towards the back electrode 220. The electrons and ions can collide with other gas particles, generating a larger population of ions. Negative ions and/or electrons exit GDI chamber 230 through the back electrode 220.

In certain embodiments, suitable electrical potentials are applied to front electrode 210 and back electrode 220 so that front electrode 210 serves as the anode and back electrode 220 serves as the cathode. In this configuration, positively charged ions generated in GDI chamber 230 leave the chamber through back electrode 220. The positively charged ions can collide with other gas particles, generating a larger population of ions.

After ions are generated and leave GDI chamber 230 through back electrode 220 in either operating mode, the ions enter ion trap 104 through end cap electrode 304. In general, back electrode 220 can include one or more apertures 240. The number of apertures 240 and their cross-sectional shapes are generally chosen to create a relatively uniform spatial distribution of ions incident on end cap electrode 304. As the ions generated in GDI chamber 230 leave the chamber through the one or more apertures 240 in back electrode 220, the ions spread out spatially from one another due to collisions and space-charge interactions. As a result, the overall spatial distribution of ions leaving GDI source 200 diverges. By selecting a suitable number of apertures 240 having particular cross-sectional shapes, the spatial distribution of ions leaving GDI source 200 can be controlled so that the distribution overlaps or fills all of the apertures 292 formed in end cap electrode 304. In some embodiments, an additional ion optical element (e.g., an ion lens) can be positioned between back electrode 220 and end cap electrode 304 to further manipulate the spatial distribution of ions emerging from GDI source 200. However, a particular advantage of the compact ion sources disclosed herein is that suitable ion distributions can be obtained without any additional elements between back electrode 220 and end cap electrode 304.

End cap electrode 304 of ion trap 104 can also include one or more apertures 294. In some embodiments, end cap electrode 304 includes a single aperture 294 with a cross-sectional shape that is circular, square, rectangular, or in the shape of another n-sided polygon. In certain embodiments, the aperture has an irregular cross-sectional shape. More generally, end cap electrode 304 can include multiple apertures 294, with properties similar to those discussed above.

In some embodiments, back electrode 220 and end cap electrode 304 can be formed as a single element, and ions formed in GDI chamber 230 can directly enter the ion trap 104 by passing through the element. In such embodiments, the combined back and end cap electrode can include a single aperture or multiple apertures, as described above.

Further, in certain embodiments, the end cap electrodes of ion trap 104 can function as the front electrode 210 and the back electrode 220 of GDI source 200. As will be discussed in more detail subsequently, ion trap 104 includes two end cap electrodes 304 and 306 positioned on opposite sides of the trap. By applying suitable potentials (e.g., as described above with reference to front electrode 210 and back electrode 220) to these electrodes, end cap electrode 304 can function as front electrode 210, and end cap electrode 306 can function as back electrode 220. Accordingly, in these embodiments, ion trap 104 also functions as a glow discharge ion source 102.

A variety of materials can be used to form the electrodes in ion source 102, including electrodes 210 and 220 in GDI source 200. In certain embodiments, the electrodes of ion source 102 can be made from materials such as copper, aluminum, silver, nickel, gold, and/or stainless steel. In general, materials that are less prone to adsorption of sticky particles are advantageous, as the electrodes formed from such materials typically require less frequent cleaning or replacement.

The foregoing discussion has focused on the use of GDI source 200 in spectrometer 100. However, the features, design criteria, algorithms, and aspects described above are equally applicable to other types of ion sources that can be used in spectrometer 100, such as capacitive discharge sources and thermionic emitter sources. In particular, capacitive discharge sources are well suited for use at the relatively high gas pressures at which spectrometer 100 operates. Additional aspects and features of capacitive discharge sources are disclosed, for example, in U.S. Pat. No. 7,274,015, the entire contents of which are incorporated herein by reference.

Due to the use of compact, closely spaced electrodes, the overall size of ion source 102 can be small. The maximum dimension of ion source 102 refers to the maximum linear distance between any two points on the ion source. In some embodiments, the maximum dimension of ion source 102 is 8.0 cm or less (e.g., 6.0 cm or less, 5.0 cm or less, 4.0 cm or less, 3.0 cm or less, 2.0 cm or less, 1.0 cm or less).

III. Ion Trap

As explained above in Section I, ions generated by ion source 102 are trapped within ion trap 104, where they circulate under the influence of electrical fields created by applying electrical potentials to the electrodes of ion trap 104. The potentials are applied to the electrodes of ion trap 104 by voltage source 106, after receiving control signals from controller 108. To eject the circulating ions from ion trap 104 for detection, controller 108 transmits control signals to voltage source 106 which cause voltage source 106 to modulate the amplitude of a radiofrequency (RF) field within ion trap 104. Modulation of the amplitude of the RF field causes the circulating ions within ion trap 104 to fall out of orbit and exit ion trap 104, entering detector 118 where they are detected.

To ensure that mass spectrometer 100 is both compact and consumes a relatively small amount of electrical power during operation, mass spectrometer 100 uses only a single, small mechanical pump in pressure regulation subsystem 120 to regulate its internal gas pressure. As a result, mass spectrometer 100 operates at internal gas pressures that are higher than internal pressures in conventional mass spectrometers. To ensure that gas particles drawn in to spectrometer 100 are quickly ionized and analyzed, the internal volume of mass spectrometer 100 is considerably smaller than the internal volume of conventional mass spectrometers. By reducing the internal volume of spectrometer 100, pressure regulation subsystem 120 is capable of drawing gas particles quickly into spectrometer 100. Further, by ensuring quick ionization and analysis, a user of spectrometer 100 can rapidly obtain information about a particular substance. A smaller internal volume of spectrometer 100 has the added advantage of a smaller internal surface area that is susceptible to contamination during operation. Conventional mass spectrometers use a variety of different mass analyzers, many of which have large internal volumes that are maintained at low pressure during operation, and/or consume large amounts of power during operation. For example, certain mass spectrometers use linear quadrupole mass filters, which have large internal volumes due to their extension in the axial direction, which enables mass filtering and large charge storage capacities. Some conventional mass spectrometers use magnetic sector mass filters, which are also typically large and may consume large amounts of power to generate mass-filtering magnetic fields. Conventional mass spectrometers can also use hyperbolic ion traps, which can have large internal volumes, and can also be difficult to manufacture.

Figure 3A:
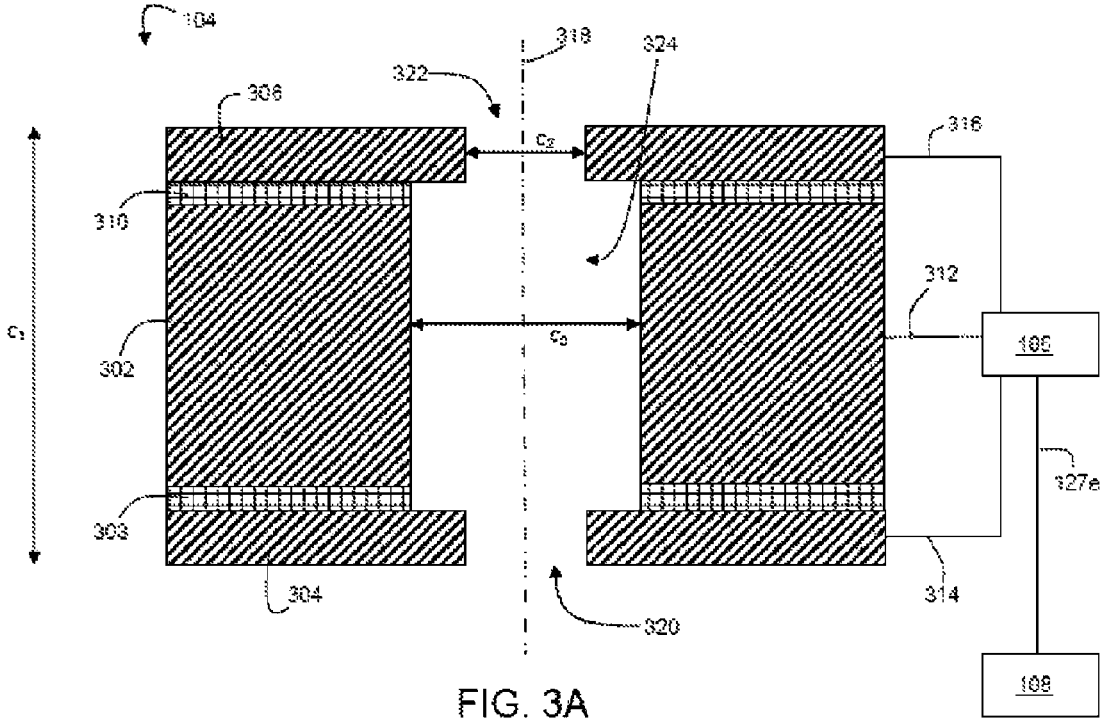
FIG. 3A is a cross-sectional diagram of an embodiment of an ion trap.

In contrast to the foregoing conventional ion trap technologies, the mass spectrometers disclosed herein use compact, cylindrical ion traps for trapping and analyzing ions. FIG. 3A is a cross-sectional diagram of an embodiment of ion trap 104. Ion trap 304 includes a cylindrical central electrode 302, two end cap electrodes 304 and 306, and two insulating spacers 308 and 310. Electrodes 302, 304, and 306 are connected to voltage source 106 via control lines 312, 314, and 316, respectively. Voltage source 106 is connected to controller 108 via control line 127*e*, controller 108 transmits signals to voltage source 106 via control line 127*e*, directing voltage source 106 to apply electrical potentials to the electrodes of ion trap 104.

During operation, ions generated by ion source 102 enter ion trap 104 through aperture 320 in electrode 304. Voltage source 106 applies potentials to electrodes 304 and 306 to create an axial field (e.g., symmetric about axis 318) within ion trap 104. The axial field confines the ions axially between electrodes 304 and 306, ensuring that the ions do not leave ion trap through aperture 320, or through aperture 322 in electrode 306. Voltage source 106 also applies an electrical potential to central electrode 302 to generate a radial confinement field within ion trap 104. The radial field confines the ions radially within the internal aperture of electrode 302.

With both axial and radial fields present within ion trap 104, the ions circulate within the trap. The orbital geometry of each ion is determined by a number of factors, including the geometry of electrodes 302, 304, and 306, the magnitudes and signs of the potentials applied to the electrodes, and the mass-to-charge ratio of the ion. By changing the amplitude of the electrical potential applied to central electrode 302, ions of specific mass-to-charge ratios will fall out of orbit within trap 104 and exit the trap through electrode 306, entering detector 118. Therefore, to selectively analyze ions of different mass-to-charge ratios, voltage source 106 (under the control of controller 108) changes the amplitude of the electrical potential applied to electrode 302 in stepwise fashion. As the amplitude of the applied potential changes, ions of different mass-to-charge ratio are ejected from ion trap 104 and detected by detector 118.

Electrodes 302, 304, and 306 in ion trap 104 are generally formed of a conductive material such as stainless steel, aluminum, or other metals. Spacers 308 and 310 are generally formed of insulating materials such as ceramics, Teflon® (e.g., fluorinated polymer materials), rubber, or a variety of plastic materials.

The central openings in end-cap electrodes 304 and 306, in central electrode 302, and in spacers 308 and 310 can have the same diameter and/or shape, or different diameters and/or shapes. For example, in the embodiment shown in FIG. 3A, the central openings in electrode 302 and spacers 308 and 310 have a circular cross-sectional shape and a diameter $c_0$, and end-cap electrodes 304 and 306 have central openings with a circular cross-sectional shape and a diameter $c_2<c_0$. As shown in FIG. 3A, the openings in the electrodes and spacers are axially aligned along axis 318 so that when the electrodes and spacers are assembled into a sandwich structure, the openings in the electrodes and spacers form a continuous axial opening that extends through ion trap 104.

In general, the diameter $c_0$ of the central opening in electrode 302 can be selected as desired to achieve a particular target resolving power when selectively ejecting ions from ion trap 104, and also to control the total internal volume of spectrometer 100. In some embodiments, $c_0$ is approximately 0.6 mm or more (e.g., 0.8 mm or more, 1.0 mm or more, 1.2 mm or more, 1.4 mm or more, 1.6 mm or more, 1.8 mm or more). The diameter $c_2$ of the central opening in end-cap electrodes 304 and 306 can also be selected as desired to achieve a particular target resolving power when ejecting ions from ion trap 104, and to ensure adequate confinement of ions that are not being ejected. In certain embodiments, $c_2$ is approximately 0.25 mm or more (e.g., 0.35 mm or more, 0.45 mm or more, 0.55 mm or more, 0.65 mm or more, 0.75 mm or more).

The axial length $c_1$ of the combined openings in electrode 302 and spacers 308 and 310 can also be selected as desired to ensure adequate ion confinement and to achieve a particular target resolving power when ejecting ions from ion trap 104. In some embodiments, $c_1$ is approximately 0.6 mm or more (e.g., 0.8 mm or more, 1.0 mm or more, 1.2 mm or more, 1.4 mm or more, 1.6 mm or more, 1.8 mm or more).

It has been determined experimentally that the resolving power of spectrometer 100 is greater when $c_0$ and $c_1$ are selected such that $c_1/c_0$ is greater than 0.83. Therefore, in certain embodiments, $c_0$ and $c_1$ are selected so that the value of $c_1/c_0$ is 0.8 or more (e.g., 0.9 or more, 1.0 or more, 1.1 or more, 1.2 or more, 1.4 or more, 1.6 or more).

Due to the relatively small size of ion trap 104, the number of ions that can simultaneously be trapped in ion trap 104 is limited by a variety of factors. One such factor is space-charge interactions among the ions. As the density of trapped ions increases, the average spacing between the trapped, circulating ions decreases. As the ions (which all have either positive or negative charges) are forced closer together, the magnitude of repulsive forces between the trapped ions increases.

Figure 3B:
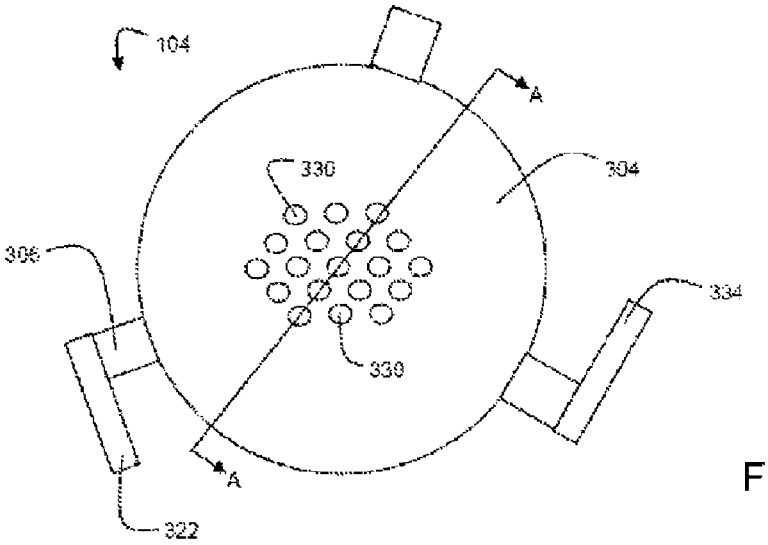
FIG. 3B is a schematic diagram of another embodiment of an ion trap.

To overcome limitations on the number of ions that can simultaneously be trapped in ion trap 104 and increase the capacity of spectrometer 100, in some embodiments spectrometer 100 can include an ion trap with multiple chambers. FIG. 3B shows a schematic diagram of an ion trap 104 with a plurality of ion chambers 330, arranged in a hexagonal array. Each chamber 330 functions in the same manner as ion trap 104 in FIG. 3A, and includes two end cap electrodes and a cylindrical central electrode. End cap electrode 304 is shown in FIG. 3B, along with a portion of end-cap electrode 306. End cap electrode 304 is connected to voltage source 106 through connection point 334, and end cap electrode 306 is connected to voltage source 106 through connection point 332.

Figure 3C:
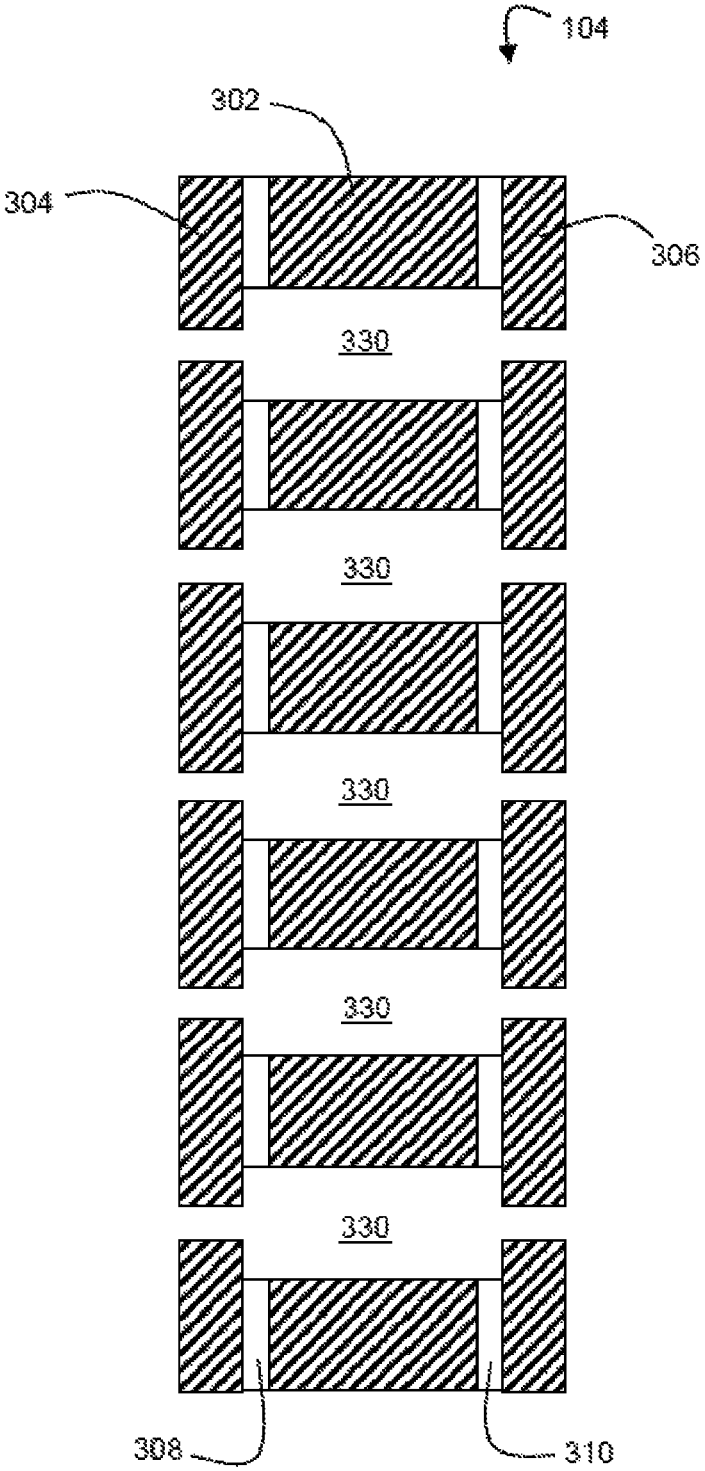
FIG. 3C is a cross-sectional diagram of the ion trap of FIG. 3B.

FIG. 3C is a cross-sectional diagram through section line A-A in FIG. 3B. Each of the five ion chambers 330 that fall along section line A-A are shown. Voltage source 106 is connected via a single connection point (not shown in FIG. 3C) to central electrode 302. As a result, by applying suitable potentials to electrode 302, voltage source 106 (under the control of controller 108) can simultaneously trap ions within each of the chambers 330, and eject ions with selected mass-to-charge ratios from each of the chambers 330.

In some embodiments, the number of ion chambers 330 in ion trap 104 can be matched to the number of apertures formed in end cap electrode 304. As described in Section II, end cap electrode 304 can, in general, include one or more apertures. When end cap electrode 304 includes a plurality of apertures, ion trap 104 can also include a plurality of ion chambers 330, so that each aperture formed in end cap electrode 304 corresponds to a different ion chamber 330. In this manner, ions generated within ion source 102 can be efficiently collected by ion trap 104, and trapped within ion chambers 330. The use of multiple chambers, as described above, reduces space-charge interactions among the trapped ions, increasing the trapping capacity of ion trap 104. In general, the positions and cross-sectional shapes of ion chambers 330 can be the same as the arrangements and shapes of apertures 240 and 294 discussed in Section II.

As an example, referring to FIG. 3B, end cap electrode 304 includes a plurality of apertures arranged in a hexagonal array. Each of the apertures formed in electrode 304 is matched to a corresponding ion chamber 330, and therefore ion chambers 330 are also arranged in a hexagonal array.

In certain embodiments, the number, arrangement, and/or cross-sectional shapes of ion chambers 330 are not matched to the arrangement of apertures in end cap electrode 304. For example, end cap electrode 304 can include only one or a small number of apertures 294, and ion trap 304 can nonetheless include a plurality of ion chambers 330. Because the use of multiple ion chambers 330 increases the trapping capacity of ion trap 104, using multiple ion chambers can provide advantages even if the arrangement of the ion chambers is not matched to the arrangement of apertures in end cap electrode 304.

Additional features of ion trap 104 are disclosed, for example, in U.S. Pat. No. 6,469,298, in U.S. Pat. No. 6,762,406, and in U.S. Pat. No. 6,933,498, the entire contents of each of which are incorporated herein by reference.

IV. Detector

Detector 118 is configured to detect charged particles leaving ion trap 104. The charged particles can be positive ions, negative ions, electrons, or a combination of these.

Figure 4A:
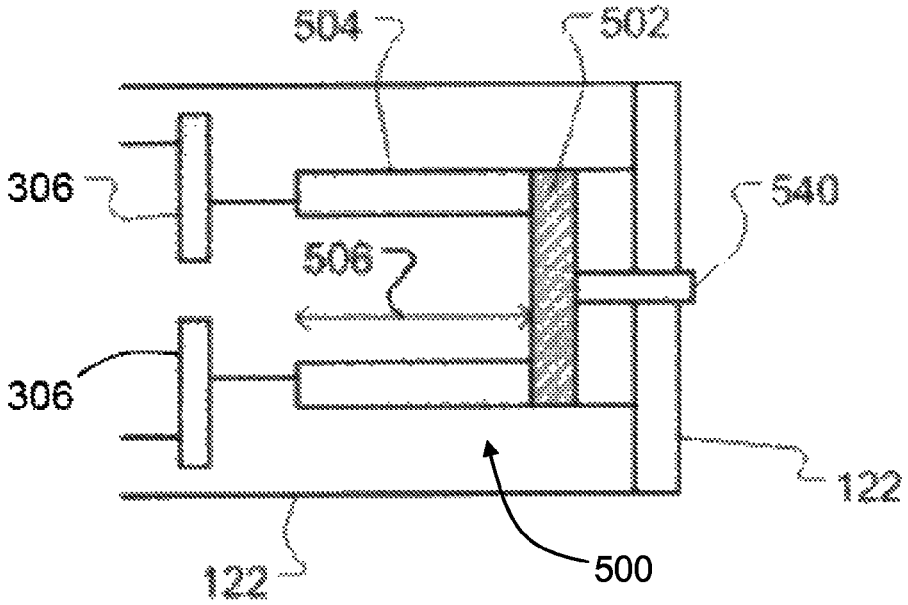
FIG. 4A is a schematic diagram of an embodiment of a Faraday cup charged particle detector.

A wide variety of different detectors can be used in spectrometer 100. In some embodiments, for example, detector 118 can include one or more Faraday cups. FIG. 4A shows a side view of a Faraday cup 500. In some embodiments, the length 506 of sidewall 504 can be 20 mm or less (e.g., 10 mm or less, 5 mm or less, 2 mm or less, 1 mm or less, or even 0 mm). In general, length 506 can be selected according to various criteria, including maintaining the compactness of spectrometer 100, providing the required selectivity during detection of charged particles, and resolution. In some embodiments, sidewall 504 conforms to the cross-sectional shape of base 502. More generally, however, sidewall 504 is not required to conform to the shape of base 502, and can have a variety of cross-sectional shapes that are different from the shape of base 502. Moreover, sidewall 504 does not have to be cylindrical in shape. In some embodiments, for example, sidewall 504 can be curved along the axial direction of Faraday cup 500.

In general, Faraday cup 500 can relatively small. The maximum dimension of Faraday cup 500 corresponds to the largest linear distance between any two points on the cup. In some embodiments, for example, the maximum dimension of Faraday cup 500 is 30 mm or less (e.g., 20 mm or less, 10 mm or less, 5 mm or less, 3 mm or less).

Typically, the thickness of base 502 and/or the thickness of sidewall 504 are chosen to ensure efficient detection of charged particles. In some embodiments, for example, the thickness of base 502 and/or of sidewall 504 are 5 mm or less (e.g., 3 mm or less, 2 mm or less, 1 mm or less).

The sidewall 504 and base 502 of Faraday cup 500 are generally formed from one or more metals. Metals that can be used to fabricate Faraday cup 500 include, for example, copper, aluminum, and silver. In some embodiments, Faraday cup 500 can include one or more coating layers on the surfaces of base 502 and/or sidewall 504. The coating layer(s) can be formed from materials such as copper, aluminum, silver, and gold.

During operation of spectrometer 100, as charged particles are ejected from ion trap 104, the charged particles can drift or be accelerated into Faraday cup 500. Once inside Faraday cup 500, the charged particles are captured at the surface of Faraday cup 500 (e.g., the surface of base 502 and/or sidewall 504). Charged particles that are captured either by base 502 or sidewall 504 generate an electrical current, which is measured (e.g., by an electrical circuit within detector 118) and reported to controller 108. If the charged particles are ions, the measured current is an ion current, and its amplitude is proportional to the abundance of the measured ions.

To obtain a mass spectrum of an analyte, the amplitude of the electrical potential applied to central electrode 302 of ion trap 104 is varied (e.g., a variable amplitude signal, high voltage RF signal 482, is applied) to selectively eject ions of particular mass-to-charge ratios from ion trap 104. For each change in amplitude corresponding to a different mass-to-charge ratio, an ion current corresponding to ejected ions of the selected mass-to-charge ratio is measured using Faraday cup 500. The measured ion current as a function of the potential applied to electrode 302—which corresponds to the mass spectrum—is reported to controller 108. In some embodiments, controller 108 converts applied voltages to specific mass-to-charge ratios based on algorithms and/or calibration information for ion trap 104.

Following ejection from ion trap 104 through end cap electrode 306, charged particles can be accelerated to impact detector 118 by forming an electric field between the detector 118 and end cap electrode 306. In certain embodiments, where detector 118 includes Faraday cup 500 for example, the conducting surface of the Faraday cup 500 is maintained at the ground potential established by voltage source 106, and a positive potential is applied to end cap electrode 306. With these applied potentials, positive ions are repelled from end cap electrode 306 toward the grounded conducting surface of Faraday cup 500. Further, electrons passing through end cap electrode 306 are attracted toward end cap electrode 306, and thus do not impact Faraday cup 500. This configuration therefore leads to improved signal-to-noise ratio. More generally, in this configuration, Faraday cup 500 can be at a potential other than ground, as long as it is at a lower potential than end cap electrode 306.

In some embodiments, it is desirable to detect negatively charged particles (e.g., negative ions and/or electrons). To detect such particles, Faraday cup 500 is biased to a higher voltage than end cap electrode 306 to attract negatively charged particles to the Faraday cup 500.

Figure 4B:
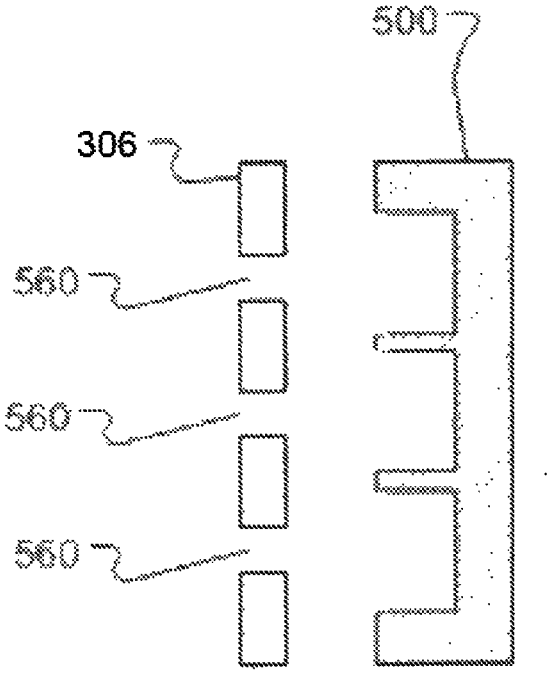
FIG. 4B is a schematic diagram of an array of Faraday cup detectors.

FIG. 4B is a schematic diagram of an embodiment of detector 118 that includes an array of Faraday cup detectors 500, which may or may not be monolithically formed. Arrays of detectors can be advantageous, for example, when ion trap 104 includes an array of ion chambers 330. End cap electrode 306 can include a plurality of apertures 560 aligned with each of the ion chambers, so that ions ejected from each chamber pass through substantially only one of the apertures 560. After passing through one of the apertures 560, the ions are incident on one of the Faraday cup detectors 500 in the array. This array-based approach to ejection and detection of ions can significantly increase the efficiency with which ejected ions are detected. In the array geometry shown in FIG. 4B, the size of each Faraday cup 500 can conform to the size of each aperture 560 formed in end cap electrode 306.

While the preceding discussion has focused on Faraday cup detectors due to their low power operation and compact size, more generally a variety of other detectors can be used in spectrometer 100. For example, other suitable detectors include electron multipliers, photomultipliers, scintillation detectors, image current detectors, Daly detectors, phosphor-based detectors, and other detectors in which incident charged particles generate photons which are then detected (i.e., detectors that employ a charge-to-photon transduction mechanism).

V. Pressure Regulation Subsystem

Pressure regulation subsystem 120 is generally configured to regulate the gas pressure in gas path 128, which includes the interior volumes of ion source 102, ion trap 104, and detector 118. As discussed above in Section I, during operation of spectrometer 100, pressure regulation subsystem 120 maintains a gas pressure within spectrometer 100 that is 100 mTorr or more (e.g., 200 mTorr or more, 500 mTorr or more, 700 mTorr or more, 1 Torr or more, 2 Torr or more, 5 Torr or more, 10 Torr or more), and/or 100 Torr or less (e.g., 80 Torr or less, 60 Torr or less, 50 Torr or less, 40 Torr or less, 30 Torr or less, 20 Torr or more).

In some embodiments, pressure regulation subsystem 120 maintains gas pressures within the above ranges in certain components of spectrometer 100. For example, pressure regulation subsystem 120 can maintain gas pressures of between 100 mTorr and 100 Torr (e.g., between 100 mTorr and 10 Torr, between 200 mTorr and 10 Torr, between 500 mTorr and 10 Torr, between 500 mTorr and 50 Torr, between 500 mTorr and 100 Torr) in ion source 102 and/or ion trap 104 and/or detector 118. In certain embodiments, the gas pressures in at least two of ion source 102, ion trap 104, and detector 118 are the same. In some embodiments, the gas pressure in all three components is the same.

In certain embodiments, gas pressures in at least two of ion source 102, ion trap 104, and detector 118 differ by relatively small amounts. For example, pressure regulation subsystem 120 can maintain gas pressures in at least two of ion source 102, ion trap 104, and detector 118 that differ by 100 mTorr or less (e.g., 50 mTorr or less, 40 mTorr or less, 30 mTorr or less, 20 mTorr or less, 10 mTorr or less, 5 mTorr or less, 1 mTorr or less). In some embodiments, the gas pressures in all three of ion source 102, ion trap 104, and detector 118 differ by 100 mTorr or less (e.g., 50 mTorr or less, 40 mTorr or less, 30 mTorr or less, 20 mTorr or less, 10 mTorr or less, 5 mTorr or less, 1 mTorr or less).

In some embodiments, pressure regulation subsystem 120 can include one or more scroll pumps. Typically, a scroll pump includes one or more interleaving scroll flanges, and during operation, relative orbital motion between the scroll flanges traps gases and liquids, leading to pumping activity. In certain embodiments, one scroll flange can be fixed while another scroll flange orbits eccentrically with or without rotation. In some embodiments, both scroll flanges move with offset centers of rotation (i.e., co-rotating scrolls). Examples of scroll flange geometries include (but are not limited to) involute, Archimedean spiral, and hybrid curves.

The orbital motion of scroll flanges allows a scroll pump generate only very small amplitude vibrations and low noise during operation. As such, scroll pumps can be directly coupled to ion trap 104 in system 100 without introducing substantial detrimental effects during mass spectrum measurements. To further reduce vibrational coupling, orbiting scroll flanges can be counterbalanced with simple masses. Because scroll pumps have few moving parts and generate only very small amplitude vibrations, the reliability of such pumps is generally very high.

Scroll pumps suitable for use in pressure regulation subsystem 120 are available, for example, from Agilent Technologies Inc. (Santa Clara, Calif.). In addition to scroll pumps, other pumps can also be used in pressure regulation subsystem 120. Examples of suitable pumps include diaphragm pumps, diaphragm pumps, and roots blower pumps.

In certain embodiments, pressure regulation subsystem 120 can include other types of pumps in addition to, or as alternatives to, scroll pumps. For example, pressure regulation subsystem 120 can include one or more roots blower pumps and/or one or more rotor/stator pumps. Combinations of any of the foregoing types of pumps can also be used in pressure regulation subsystem 120.

Using a small, single mechanical pump provides a number of advantages relative to the pumping schemes used in conventional mass spectrometers. In particular, conventional mass spectrometers typically use multiple pumps, at least one of which operates at high rotational frequency. Large mechanical pumps operating at high rotational frequencies generate mechanical vibrations that can couple into the other components of the spectrometer, generating undesirable noise in measured information. In addition, even if measures are taken to isolate the components from such vibrations, the isolation mechanisms typically increase the size of the spectrometers, sometimes considerably. Furthermore, large pumps operating at high frequencies consume large amounts of electrical power. Accordingly, conventional mass spectrometers include large power supplies for meeting these requirements, further enlarging the size of such instruments.

In contrast, a single mechanical pump such as a scroll pump can be used in the spectrometers disclosed herein to control gas pressures in each of the components of the system. By operating the mechanical pump at a relatively low rotational frequency, the mechanical coupling of vibrations into other components of the spectrometer can be substantially reduced or eliminated. Further, by operating at low rotational frequencies, the amount of power consumed by the pump is small enough that its modest requirements can be met by voltage source 106.

It has been determined experimentally that in some embodiments, by operating the single mechanical pump at a frequency of less than 6000 cycles per minute (e.g., less than 5000 cycles per minute, less than 4000 cycles per minute, less than 3000 cycles per minute, less than 2000 cycles per minute), the pump is capable of maintaining desired gas pressures within spectrometer 100, and at the same time, its power consumption requirements can be met by voltage source 106.

In some embodiments, spectrometer 100 is configured to operate at even higher gas pressures, e.g., at pressures up to 1 atm (e.g., 760 Torr). That is, the internal gas pressure in one or more of ion source 102, ion trap 104, and/or detector 118 is between 100 Torr and 760 Torr (e.g., 200 Torr or more, 300 Torr or more, 400 Torr or more, 500 Torr or more, 600 Torr or more) when spectrometer 100 is detecting ions according to a mass-to-charge ratio for the ions.

Certain components disclosed herein are already well suited to operation at pressures of up to 1 atm (and even higher pressures). For example, some of the ion sources disclosed herein, such as glow discharge ion sources, can operate at pressures up to 1 atm with little or no modification. In addition, certain types of detectors such as Faraday detectors (e.g., Faraday cup detectors and arrays thereof) can also operate at pressures of up to 1 atm with little or no modification.

The ion traps disclosed herein can be modified for operation at pressures of up to 1 atm. For example, to operate at pressures of 1 atm, dimension $c_0$ of ion trap 104 can be reduced to between 1.5 microns and 0.5 microns (e.g., between 1.5 microns and 0.7 microns, between 1.2 microns and 0.5 microns, between 1.2 microns and 0.8 microns, approximately 1 micron). Further, to operate at gas pressure of up to 1 atm, voltage source 106 can be modified to provide sweeping voltages to ion trap 104 that repeat with a frequency in the GHz range, e.g., a frequency of 1.0 GHz or more (e.g., 1.2 GHz or more, 1.4 GHz or more, 1.6 GHz or more, 2.0 GHz or more, 5.0 GHz or more, or even more). With these modifications to ion trap 104 and voltage source 106, mass spectrometer 100 can operate at pressures of up to 1 atm, so that the use of pressure regulation subsystem 120 is significantly curtailed. In some embodiments, it can even be possible to eliminate pressure regulation subsystem 120 from spectrometer 100, e.g., so that spectrometer 100 is a pump-less spectrometer.

VI. Housing

Figure 5:
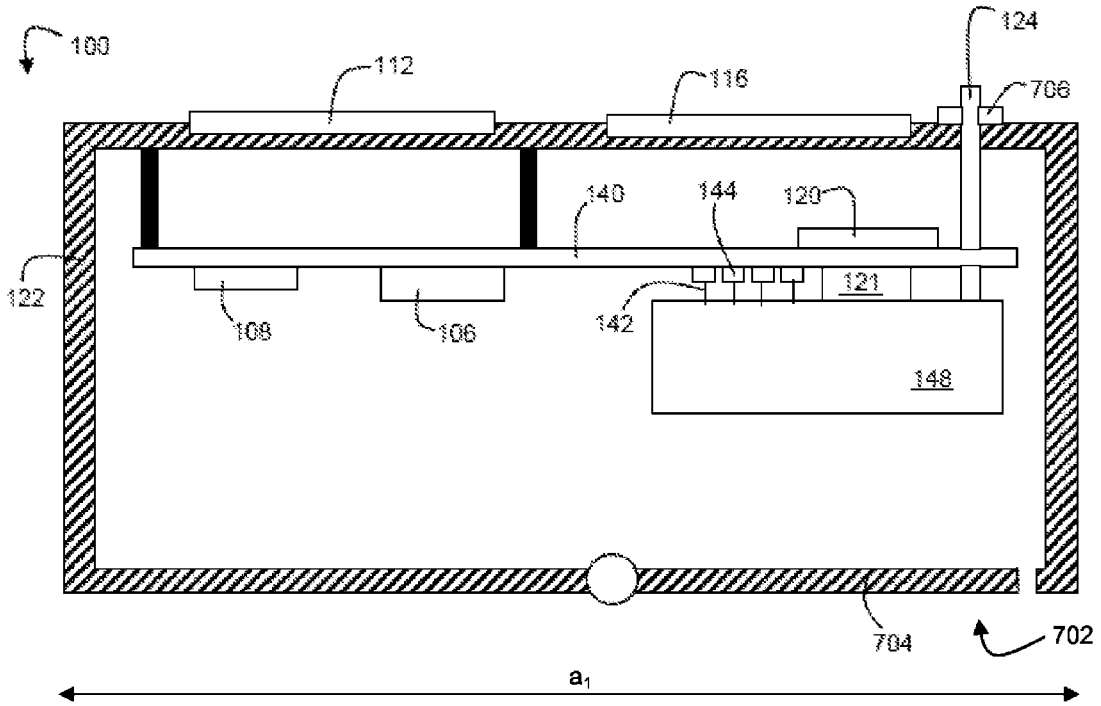
FIG. 5 is a cross-sectional diagram of an embodiment of a compact mass spectrometer.

As described above in Section I, mass spectrometer 100 includes a housing 122 that encloses the components of the spectrometer. FIG. 5 shows a schematic diagram of an embodiment of housing 122. Sample inlet 124 is integrated within housing 122 and configured to introduce gas particles into gas path 128. Also integrated into housing 122 are display 116 and user interface 112.

In some embodiments, display 116 is a passive or active liquid crystal or light emitting diode (LED) display. In certain embodiments, display 116 is a touchscreen display. Controller 108 is connected to display 116, and can display a variety of information to a user of mass spectrometer 100 using display 116. The information that is displayed can include, for example, information about an identity of one or more substances that are scanned by spectrometer 100. The information can also include a mass spectrum (e.g., measurements of abundances of ions detected by detector 118 as a function of mass-to-charge ratio). In addition, information that is displayed can include operating parameters and information for mass spectrometer 100 (e.g., measured ion currents, voltages applied to various components of mass spectrometer 100, names and/or identifiers associated with the current module 148 installed in spectrometer 100, warnings associated with substances that are identified by spectrometer 100, and defined user preferences for operation of spectrometer 100). Information such as defined user preferences and operating settings can be stored in storage unit 114 and retrieved by controller 108 for display In some embodiments, user interface 112 includes a series of controls integrated into housing 122. The controls, which can be activated by a user of spectrometer 100, can include buttons, sliders, rockers, switches, and other similar controls. By activating the controls of user interface 112, a user of spectrometer 100 can initiate a variety of functions. For example, in some embodiments, activation of one of the controls initiates a scan by spectrometer 100, during which spectrometer draws in a sample (e.g., gas particles) through sample inlet 124, generates ions from the gas particles, and then traps and analyzes the ions using ion trap 104 and detector 118. In certain embodiments, activation of one of the controls resets spectrometer 100 prior to performing a new scan. In some embodiments, spectrometer 100 includes a control that, when activated by a user, re-starts spectrometer 100 (e.g., after changing one of the components of spectrometer 100 such as module 148 and/or a filter connected to sample inlet 124).

When display 116 is a touchscreen display, a portion, or even all, of user interface 112 can be implemented as a series of touchscreen controls on display 116. That is, some or all of the controls of user interface 112 can be represented as touch-sensitive areas of display 116 that a user can activate by contacting display 116 with a finger.

As described in Section I, in some embodiments, mass spectrometer 100 includes a replaceable, pluggable module 148 that includes ion source 102, ion trap 104, and (optionally) detector 118. When mass spectrometer 100 includes a pluggable module 148, housing 122 can include an opening to allow a user to access the interior of housing 122 to replace module 148, without disassembling housing 122. As shown in FIG. 5, housing 122 can include an optional opening 702 and a closure 704 that seals opening 702. When module 148 is to be replaced, a user of spectrometer 100 can open closure 704 to expose the interior of spectrometer 100. Closure 704 is positioned so that it provides direct access to pluggable module 148, allowing the user to unplug module 148 from support base 140, and to install another module in its place, without disassembling housing 122. The user can then re-seal opening 702 by fastening closure 704. In FIG. 5, closure 704 is implemented in the form of a retractable door. More generally, however, a wide variety of closures can be used to seal the opening in housing 122. For example, in some embodiments, closure 704 can be implemented as a lid that is fully detachable from housing 122.

In general, mass spectrometer 100 can include a variety of different sample inlets 124. For example, in some embodiments, sample inlet 124 includes an aperture configured to draw gas particles directly from the environment surrounding spectrometer 100 into gas path 128. Sample inlet 124 can include one or more filters 706. For example, in some embodiments, filter 706 is a HEPA filter, and prevents dust and other solid particles from entering spectrometer 100. In certain embodiments, filter 706 includes a molecular sieve material that traps water molecules.

As discussed previously, conventional mass spectrometers operate at low internal gas pressures. To maintain low gas pressures, conventional mass spectrometers include one or more filters attached to sample inlets. These filters are selective, and filter out particles of certain types of substances, such as atmospheric gas particles (e.g., nitrogen and/or oxygen molecules) from entering the mass spectrometer. The filters can also be specifically tailor for certain classes of analytes such as biological molecules, and can filter out other types of molecules. As a result, the filters that are used in conventional mass spectrometers—which can include pinch valves, and membrane filters formed from materials such as polydimethylsiloxane which permit selective transport of substances—filter the incoming stream of gas particles to remove certain types of particles from the stream. Without such filters, conventional mass spectrometers could not function, as the low internal gas pressure could not be maintained, and some of the particles admitted into the mass spectrometers would prevent operation of certain components. As an example, thermionic ion sources that are used in conventional mass spectrometers do not operate in the presence of even moderate concentrations of atmospheric oxygen.

The use of substance-specific filters in conventional mass spectrometers has a number of disadvantages. For example, because the filters are selective, fewer analytes can be analyzed without changing filters and/or operating conditions, which can be cumbersome. In particular, for an untrained user of a mass spectrometer, re-configuring the spectrometer for specific analytes by choosing an appropriate selective filter may be difficult. Further, the filters used in conventional mass spectrometers introduce a time delay, because analyte particles do not diffuse instantly through the filters. Depending upon the selectivity of the filters and the concentration of the analyte, a considerable delay can be introduced between the time the analyte is first encountered, and the time when sufficient quantities of analyte ions are detected to generate mass spectral information.

However, because the systems disclosed herein operate at higher pressures, there is no need to include a filter such as a membrane filter to maintain low gas pressures within the spectrometer. By operating without the types of filters that are used in conventional mass spectrometers, the systems disclosed herein can analyze a greater number of different types of samples without significant re-configuration, and can perform analyses faster. Moreover, because the components of the spectrometers disclosed herein are generally not sensitive to atmospheric gases such as nitrogen and oxygen, these gases can be admitted to the spectrometers along with particles of the analyte of interest, which significantly increases the speed of analysis and decreases the operating requirements (e.g., the pumping load on pressure regulation subsystem 120) of the other components of the spectrometers.

Accordingly, in general, the filters used in the spectrometers disclosed herein (e.g, filter 706) do not filter atmospheric gas particles (e.g., nitrogen molecules and oxygen molecules) from the stream of gas particles entering sample inlet 124. In particular, filter 706 allows at least 95% or more of the atmospheric gas particles that encounter the filter to pass through.

Housing 122 is generally shaped so that it can be comfortably operated by a user using either one hand or two hands. In general, housing 122 can have a wide variety of different shapes. However, due to the selection and integration of components of spectrometer 100 disclosed herein, housing 122 is generally compact. As shown in FIG. 5, regardless of overall shape, housing 122 has a maximum dimension at that corresponds to a longest straight-line distance between any two points on the exterior surface of the housing. In some embodiments, at is 35 cm or less (e.g., 30 cm or less, 25 cm or less, 20 cm or less, 15 cm or less, 10 cm or less, 8 cm or less, 6 cm or less, 4 cm or less).

Further, due to the selection of components within spectrometer 100, the overall weight of spectrometer 100 is significantly reduced relative to conventional mass spectrometers. In certain embodiments, for example, the total weight of spectrometer 100 is 4.5 kg or less (e.g., 4.0 kg or less, 3.0 kg or less, 2.0 kg or less, 1.5 kg or less, 1.0 kg or less, 0.5 kg or less).

VII. Operating Modes

Figure 6A:
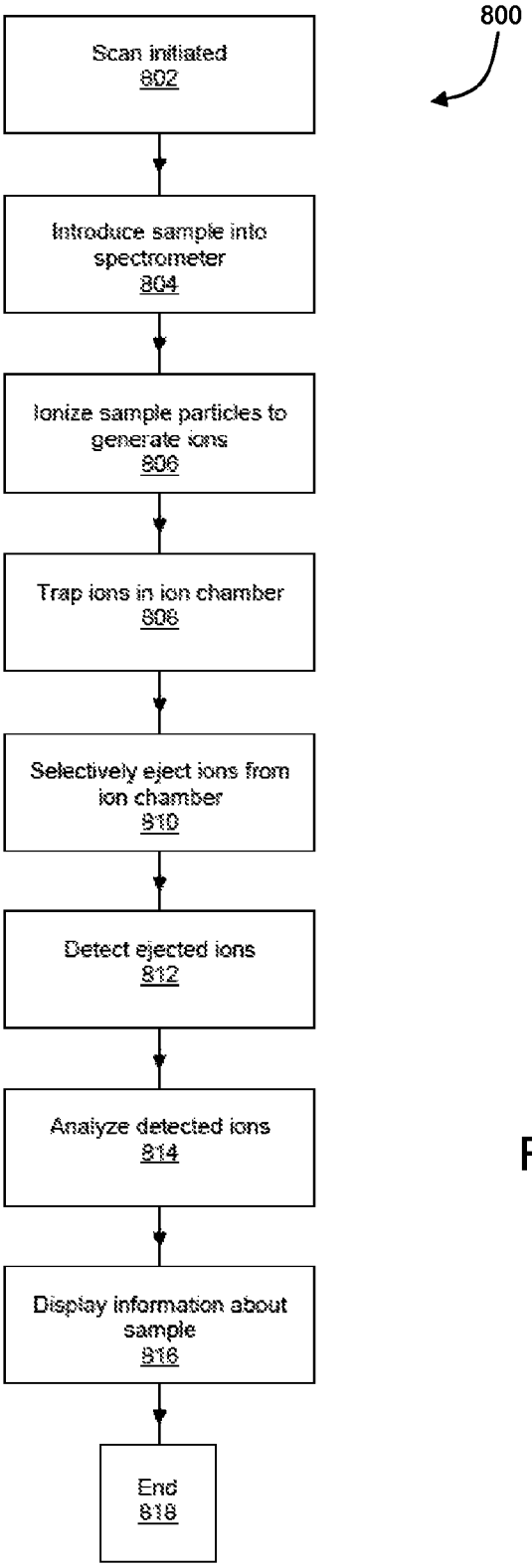
FIG. 6A is a flow chart showing a series of steps for measuring mass spectral information and displaying information about a sample.

In general, mass spectrometer 100 operates according to a variety of different operating modes. FIG. 6A is a flow chart 800 that shows a general sequence of steps that are performed in the different operating modes to scan and analyze a sample. In the first step 802, a scan of the sample is initiated. In some embodiments, the scan is initiated by a user of spectrometer 100. For example, spectrometer 100 can be configured to operate in a "one touch" mode where the user can initiate a scan of a sample simply by activating a control in user interface 112. In some embodiments, controller 108 can initiate a scan automatically based on one or more sensor readings. For example, when spectrometer 100 includes limit sensors such as photoionization detectors and/or LEL sensors, controller 108 can monitor signals from these sensors. If the sensors indicate that a substance of potential interest has been detected, for example, controller 108 can initiate a scan. In general, a wide variety of different sensor-based events or conditions can be used by controller 108 to initiate a scan automatically.

In certain embodiments, spectrometer 100 can be configured to run in "continuous scan" mode. After spectrometer 100 has been placed in continuous scan mode, a scan is repeatedly initiated after expiration of a fixed time interval. The time interval is configurable by the user, and the value of the time interval can be stored in storage unit 114 and retrieved by controller 108. Thus, in step 802 of FIG. 6A, the scan is initiated by spectrometer 100 when the spectrometer is in continuous scan mode.

After the scan has been initiated, the sample is introduced into spectrometer 100 in step 804. A variety of different methods can be used to introduce the sample into the spectrometer. In some embodiments, where the sample consists of gas particles, controller 108 activates valve 129, opening the value to admit the gas particles into spectrometer 100 (e.g., into gas path 128). If sample inlet 124 includes a filter 706, the gas particles pass through the filter, which removes dust and other solid materials from the stream of gas particles. As disclosed above, the pressure regulation subsystem maintains a gas pressure that is less than atmospheric pressure in gas path 128. As a result, when valve 129 opens, gas particles 822 are drawn in to sample inlet 124 by the pressure differential between gas path 128 and the environment surrounding spectrometer 100. Alternatively, or in addition, pressure regulation subsystem 120 can cause the gas particles to flow into spectrometer 100.

In certain embodiments, a sample in a partially ionized state can be drawn into spectrometer 100 by electrostatic or electrodynamic forces. For example, by applying suitable electrical potentials to electrodes in spectrometer 100, charged particles can be accelerated into spectrometer 100 (e.g., through sample inlet 124).

Next, in step 806, the sample is ionized in ion source 102. As disclosed above, a sample inlet 124 can be positioned in different locations along gas path 128, relative to the other components of spectrometer 100. For example, in some embodiments, sample inlet 124 is positioned so that gas particles introduced into spectrometer 100 enter ion trap 104 first from sample inlet 124. In certain embodiments, sample inlet 124 is positioned so that gas particles introduced into spectrometer 100 enter ion source 102 first from sample inlet 124. In some embodiments, sample inlet 124 is positioned so that gas particles enter detector 118 first from sample inlet 124. Still further, sample inlet 124 can be positioned so that gas particles that enter spectrometer 100 enter gas path 128 at a point between ion source 102 and/or ion trap 104 and/or detector 118.

After the sample (e.g., as gas particles 822) has been introduced into spectrometer 100 at a point along gas path 128, some of the gas particles enter ion source 102. If sample inlet 124 is not positioned so that gas particles 822 enter ion source 102 directly, then movement of gas particles 822 into ion source 102 occurs by diffusion. Once inside ion source 102, controller 108 activates ion source 102 to ionize the gas particles.

Next, the ions generated in step 806 are trapped in ion trap 104 in step 808. As disclosed above, movement of the ions from ion source 102 to ion trap 104 generally occurs under the influence of electric fields generated between ion source 102 and ion trap 104. Once inside ion trap 104, the ions are trapped by electric fields internal to the trap, and circulate within the opening in central electrode 302, and between end cap electrodes 304 and 306. The electric fields within ion trap 104 are generated by voltage source 106 under the control of controller 108, which applies suitable electrical potentials to electrodes 302, 304, and 306 to generate the trapping fields.

In step 810, the trapped, circulating ions in ion trap 104 are selectively ejected from the trap. Selective ejection of ions from trap 104 occurs under the control of controller 108, which transmits signals to voltage source 106 to vary the amplitude of the applied RF voltage to the central electrode 302. As the amplitude of the potential is varied, the amplitude of the electric field in the internal opening of central electrode 302 also varies. Further, as the amplitude of the field within central electrode 302 varies, circulating ions with specific mass-to-charge ratios fall out of circulating orbit within central electrode 302, and are ejected from ion trap 104 through one or more apertures in end cap electrode 306. Controller 108 is configured to direct voltage source 106 to sweep the amplitude of the applied potential according to a defined function (e.g., a linear amplitude sweep) to selectively eject ions of specific mass-to-charge ratios from ion trap 104 into detector 118. The rate at which the applied potential is swept can be determined automatically by controller 108 (e.g., to achieve a target resolving power of spectrometer 100), and/or can be set by a user of spectrometer 100.

After the ions have been selectively ejected from ion trap 104, they are detected by detector 118 in step 812. A variety of different detectors can be used to detect the ions. For example, in some embodiments, detector 118 includes a Faraday cup that is used to detect the ejected ions.

For each mass-to-charge ratio selected by the amplitude of the electrical potential applied to central electrode 302 in ion trap 104, detector 118 measures a current related to the abundance of ions detected with the selected mass-to-charge ratio. The measured currents are transmitted to controller 108. As a result, the information that controller 108 receives from detector 118 corresponds to detected abundances of ions as a function of mass-to-charge ratio for the ions. This information corresponds to a mass spectrum of the sample.

More generally, controller 108 is configured to detect ions according to a mass-to-charge ratio for the ions, which means that controller 108 detects or receives signals that correlate with the detection of ions and are related to the mass-to-charge ratio for the ions. In some embodiments, controller 108 detects ions or receives information about ions directly as a function of mass-to-charge ratio. In certain embodiments, controller 108 detects ions or receives information about ions as a function of another quantity, such as an electrical potential applied to ion trap 104, that is related to the mass-to-charge ratio for the ions. In all such embodiments, controller 108 detects ions according to a mass-to-charge ratio.

In step 814, the information received from detector 118 is analyzed by controller 108. In general, to analyze the information, controller 108 (e.g., electronic processor 110 in controller 108) compares the mass spectrum of the sample to reference information to determine whether the mass spectrum of the sample is indicative of any of the known substances. The reference information can be stored, for example, in storage unit 114, and retrieved by controller 108 to perform the analysis. In some embodiments, controller 108 can also retrieve reference information from databases that are stored at remote locations. For example, controller 108 can communicate with such databases using communication interface 117 to obtain mass spectra of known substances, for use in analyzing the information measured by detector 118.

The information measured by detector 118 is analyzed by controller 108 to determine information about an identity of the sample. If the sample includes multiple compounds, controller 108—by comparing the measured information from detector 118 to reference information—can determine information about the identities of some or all of the multiple compounds.

Controller 108 is configured to determine a variety of information about the identity of a sample. For example, in some embodiments, the information includes one or more of the sample's common name, IUPAC name, CAS number, UN number, and/or its chemical formula. In certain embodiments, the information about the identity of the sample includes information about whether the sample belongs to a certain class of substances (e.g., explosives, high energy materials, fuels, oxidizers, strong acids or bases, toxic agents). In some embodiments, the information can include information about hazards associated with the sample, handling instructions, safety warnings, and reporting instructions. In certain embodiments, the information can include information about a concentration or level of the sample measured by the spectrometer.

In certain embodiments, the information can include an indication as to whether or not the sample corresponds to a target substance. For example, when a scan is initiated in step 802, a user of spectrometer 100 can place the spectrometer in targeting mode, in which spectrometer 100 scans samples to specifically determine whether a sample corresponds to any of a series of identified target substances. Controller 108 can use a variety of data analysis techniques such as digital filtering and expert systems to search for particular spectral features in the measured mass spectral information. For a particular target substance, controller 108 can search for particular mass spectral features that are characteristic for the target substance, such as peaks at particular mass-to-charge ratios. If certain spectral features are missing from the measured mass spectral information, or if the measured information includes spectral features where none should appear, the information about the identity of the sample determined by controller 108 can include an indication that the sample does not correspond to the target substance. Controller 108 can be configured to determine such information for multiple target compounds.

After the sample analysis is complete, controller 108 displays information about the sample to the user in step 816, using display 116. The information that is displayed depends upon the operating mode of spectrometer 100 and the actions of the user. As discussed above, spectrometer 100 is configured so that it can be used by persons who do not have special training in the interpretation of mass spectra. For persons without such training, complete mass spectra (e.g., ion abundances as a function of mass-to-charge ratio) often carry little meaning. As a result, spectrometer 100 is configured so that in step 816, it does not display the measured mass spectrum of the sample to the user. Instead, spectrometer 100 displays only some (or all) of the information about the identity of the sample, as determined in step 814, to the user. For users without special training, information about the identity of the sample is of primary significance.

In addition to the information about the identity of the sample, controller 108 can also display other information. For example, in some embodiments, spectrometer 100 can access a database (e.g., stored in storage unit 114, or accessible via communication interface 117) of known hazardous materials. If the information about the identity of the sample is present in the database of hazardous materials, controller 108 can display alerting messages and/or additional information to the user. The alerting messages can include, for example, information about the relative hazardousness of the sample. The additional information can include, for example, actions that the user should consider taking, including actions to limit exposure of the user or others to the substance, and other security-related actions.

In some embodiments, spectrometer 100 is configured to display the mass spectrum of the sample to the user when a control is activated. This information can be useful, for example, when a conclusive match between the measured mass spectral information and reference information is not obtained and/or for analyses in laboratories, to infer more detailed chemical information, such as the fragmentation mechanism for particular ions.

In step 818, the process shown in flow chart 800 terminates. If the scan was initiated in step 802 by the user activating control 820, then spectrometer 100 waits for control 820 to be activated again before initiating another scan. Alternatively, if spectrometer 100 is in continuous scan mode, then spectrometer 100 waits for a defined time interval, and then initiates another scan automatically after the interval has elapsed, or waits for another external trigger such as a sensor signal.

Useful information about a sample, including information about the identity of the sample, can often be obtained and provided to a user by measuring the sample's mass spectrum even when the mass spectrometer's resolution is less than optimum, e.g., the resolution is lower than the highest possible value. In particular, sufficiently precise correspondences between measured mass spectral information and reference information can be achieved even when mass spectrometer 100 operates at a higher internal gas pressure—and therefore a poorer resolution—than conventional mass spectrometers.

Because mass spectrometer 100 can operate at lower resolution than a conventional mass spectrometer, mass spectrometer 100 can be further configured, in some embodiments, to adaptively adjust the operation of certain components to further reduce its overall power consumption. Components are adaptively operated either to achieve a target resolution in the measured mass spectral information, or to achieve a sufficient correspondence between the mass spectral information and reference information on a known substance or condition.

Figure 6B:
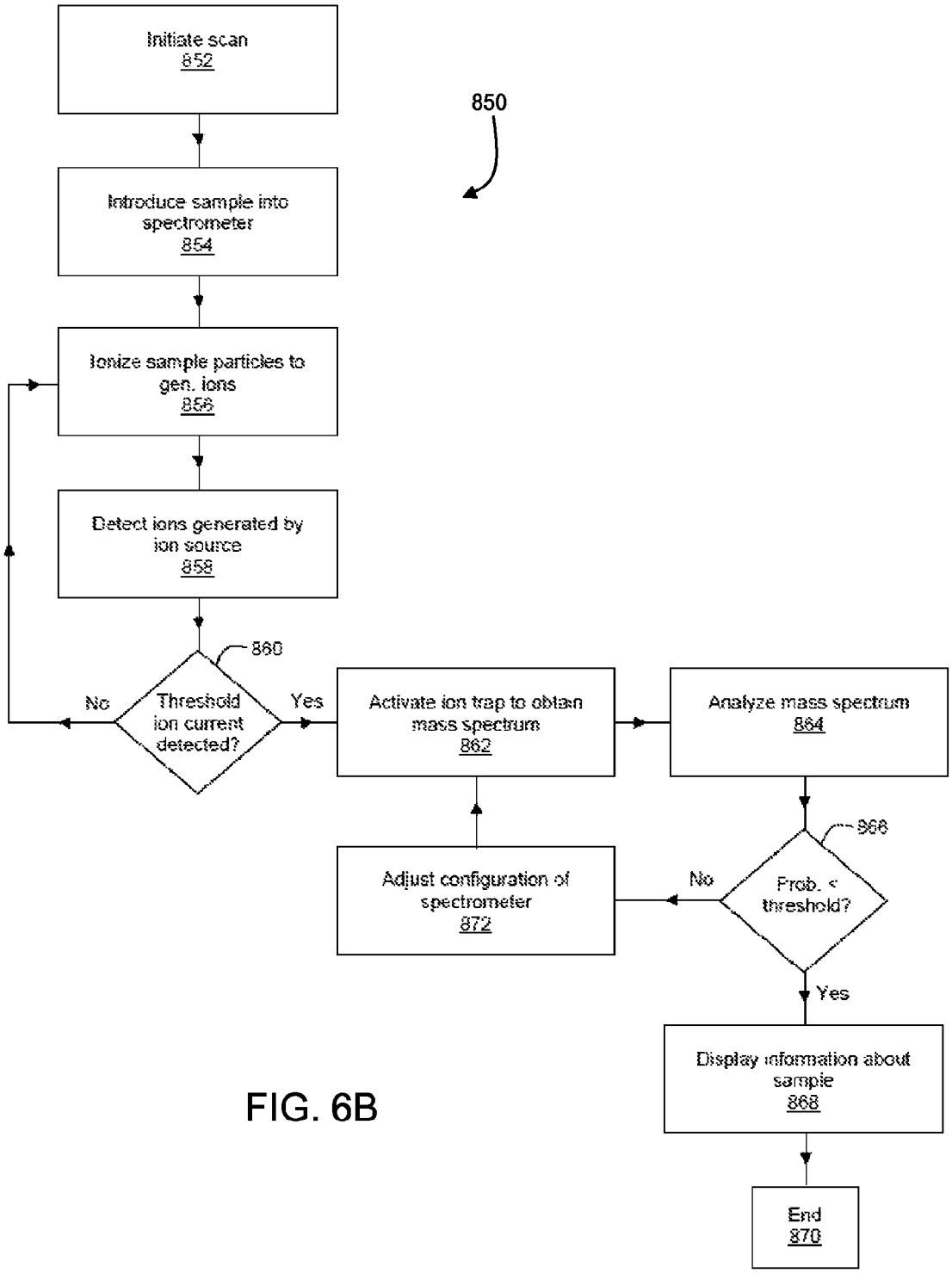
FIG. 6B is a flow chart showing a series of steps for measuring mass spectral information and adjusting a configuration of a mass spectrometer.

FIG. 6B shows a flow chart 850 that includes a series of steps for adaptive operation of mass spectrometer 100 to achieve a sufficient correspondence between measured mass spectral information and reference information on a known substance or condition. The target resolution can be set by the user of mass spectrometer 100 (e.g., either through a user-defined setting, or through visual inspection of measured mass spectral information), or set automatically by controller 108. In first step 852, a scan is initiated in the same manner as disclosed above in connection with step 802. Next, in step 854, a sample is introduced into spectrometer 100 in the same manner as disclosed above in connection with step 804. In step 856, sample particles are ionized to produce ions, as disclosed above in connection with step 806.

Then, in step 858, sample ions generated by ion source 102 are detected using detector 118. Step 858 can be performed without activating ion trap 104 to trap or selectively eject ions. Instead, in step 858, ions generated by ion source 102 pass directly through end cap electrodes 304 and 306 of ion trap 104, and are incident on detector 118. Voltage source 106 can be configured to apply electrical potentials to electrodes in ion source 102 and detector 118 to create an electric field between ion source 102 and detector 118 to promote the transport of ions.

Next, in step 860, controller 108 determines whether a threshold ion current has been detected by detector 118. The threshold ion current can be a user-defined and/or user-adjustable setting of spectrometer 100. Alternatively, the threshold ion current can be determined automatically by spectrometer 100 based on, for example, a measurement of dark current and/or noise in detector 118 by controller 108. If the threshold current has not yet been reached, ionization of the sample and detection of sample ions continues in steps 856 and 858. Alternatively, if the threshold ion current has been reached, controller 108 activates ion trap 104 in step 862 to trap and selectively eject ions into detector 118. The ejected ions are detected by detector 118, and the mass spectral information is analyzed by controller 108 in step 864 in an attempt to determine information about an identity of the sample.

As part of the analysis in step 864, controller 108 can determine a probability that the measured mass spectral information for the sample originates from a known substance or condition. In step 866, controller 108 compares the determined probability to a threshold probability to determine whether the analysis of the mass spectral information is limited by the resolution of spectrometer 100. If the probability is larger than the threshold value, then controller 108 displays information about the sample (e.g., an identity of the sample and/or information about an identity of the sample) using display 116, and the process concludes at step 870. However, if the probability is less than the threshold probability value in step 866, then the analysis of the mass spectral information may be limited by the resolution of spectrometer 100.

In some embodiments, step 866 includes determining whether a probability of correct detection is sufficiently large (e.g., exceeds a threshold probability value). The probability of correct detection corresponds to a probability that the mass spectral information correctly matches spectral information for a known substance. Such probabilities can be calculated in a variety of ways, including for example by using correspondences between the observed and known fragmentation patterns of target analytes, using abstract features of the observed measurements known to be predictive of analyte presence, using decision trees based on the measured conditions and observed fragmentation patterns from the unknown materials, and using dynamic properties of the unknown samples such its response to positive and negative ionization, or axial excitation. If the probability of correct detection is too low, controller 108 adjusts the configuration of the spectrometer in step 872.

In certain embodiments, step 866 includes determining whether a probability of a false alarm is sufficiently low (e.g., is smaller than a threshold probability value). The probability of a false alarm corresponds to a probability that the measured spectral information corresponds to known spectral information for one or more substances that are hazardous and/or targeted for detection by spectrometer 100 and/or a user of the spectrometer. The probability of a false alarm can be calculated, for example, from the degree of confusion in the algorithms, or the vagueness of the posterior probability distributions. If the probability of a false alarm is sufficiently low (e.g., smaller than the threshold value), then spectrometer 100 continues to step 868. Alternatively, if the probability of a false alarm exceeds the threshold value, controller 108 adjusts the configuration of the spectrometer in step 872.

To increase the enhance the resolution of spectrometer 100, controller 108 adaptively adjusts the configuration of the spectrometer, before control returns to step 862. Controller 108 is configured to adjust the configuration in a variety of ways to increase the resolution of spectrometer 100. In some embodiments, controller 108 is configured to activate buffer gas source 150 to introduce buffer gas particles into gas path 128. The introduced buffer gas particles can include, for example, nitrogen molecules, hydrogen molecules, or atoms of a noble gas such as helium, argon, neon, or krypton. Buffer gas source 150 can include a replaceable cylinder containing the buffer gas particles, and a valve connected to controller 108 via control line 127*g*, or a buffer gas generator. Controller 108 can be configured to activate the valve in buffer gas source 150 so that controlled quantities of buffer gas particles are released into gas path 128. Once released into gas path 128, the buffer gas particles mix with the ions generated by ion source 102, and facilitate trapping and selective ejection of the ions into detector 118, thereby increasing the resolving power of spectrometer 100.

In certain embodiments, controller 108 reduces the internal gas pressure in spectrometer 100 to increase the resolving power of spectrometer 100. To reduce the internal gas pressure, controller 108 activates pressure regulation subsystem 120 via control line 127*d*. Alternatively, or in addition, controller 108 can close valve 129 to reduce the internal gas pressure. In some embodiments, valve 129 can be alternately opened and closed in pulsed fashion with a particular duty cycle to reduce the internal gas pressure. In certain embodiments, spectrometer 100 can include multiple sample inlets, and valve 129 can be closed to seal sample inlet 124, while another in-line valve in a smaller diameter sample inlet can be opened. By using a different sample inlet to reduce the gas pressure in spectrometer 100, no change in pumping speed is necessary. Reducing the internal gas pressure in spectrometer 100 increases the resolution of spectrometer 100 by reducing the frequency of collisions between ions in ion source 102, ion trap 104, and detector 118.

In some embodiments, to improve the resolution of spectrometer 100, controller 108 increases the frequency at which the electrical potential applied to center electrode 302 changes. By decreasing the rate at which the applied potential changes, the rate at which the internal electric field within electrode 302 changes is also decreased. As a result, the selectivity with which ions are ejected from ion trap 104 increases, improving the resolution of spectrometer 100.

In certain embodiments, controller 108 is configured to change the axial electric field frequency or amplitude within ion trap 104 to change the resolution of spectrometer 100. Changing the axial electric field in ion trap 104 can shift the ejection boundary of the ion trap, thereby either extending or reducing the high-mass range of the spectrometer and modifying the resolving power and/or resolution of spectrometer 100.

In some embodiments, controller 108 is configured to increase the resolution of spectrometer 100 by changing a duty cycle of ion source 102. Reducing the ionization time has been observed experimentally to improve resolution in mass spectrometer 100. Thus, by reducing the duration of time during which a bias potential is applied to ion source 102 (e.g., reducing the duty cycle of ion source 102), the resolution of spectrometer 100 can be increased.

Conversely, reducing the resolution of spectrometer 100 can also be useful in certain situations. For example, by increasing the duration of time during which a bias potential is applied to ion source 102 (e.g., increasing the duty cycle of ion source 102), and therefore reducing the duration of time over which the amplitude of the potential applied to electrode 302 of ion trap 104 is increased, the resolution of spectrometer 100 is reduced, but the sensitivity of spectrometer 100 increases, thereby increasing the signal-to-noise ratio of the mass spectral information measured using spectrometer 100. The increased sensitivity can be particularly useful when attempting to detect very low concentrations of certain substances.

In certain embodiments, controller 108 is configured to increase the resolution of spectrometer 100 by increasing the duration of time over which the electrical potential applied to electrode 302 of ion trap 104 is increased. By increasing the sweep duration, circulating ions are ejected more slowly from ion trap 104, increasing the resolution of the measured mass spectral information.

In some embodiments, controller 108 is configured to change the resolution of spectrometer 100 by adjusting the ramp profile associated with the amplitude sweep of the potential applied to electrode 302. The amplitude of the potential applied to electrode 302 typically increases according to a linear ramp function. More generally, however, controller 108 can be configured to increase the amplitude of the potential applied to electrode 302 according to a different ramp profile. For example, the ramp profile can be adjusted by controller 108 so that the applied potential increases according to a series of different linear ramp profiles, each of which represents a different rate of increase of the potential. As another example, the ramp profile can be adjusted so that the amplitude of the potential applied to electrode 302 increases according to a nonlinear function such as an exponential function or a polynomial function.

As discussed above, controller 108 is configured to take any one or more of the above actions to change the resolution of spectrometer 100. The order in which these actions are taken can either be determined by spectrometer 100, or by user selected preferences. For example, in some embodiments, a user of spectrometer 100 can designate which of the above steps, and in which order, controller 108 takes to increase the resolution and/or reduce the power consumption of spectrometer 100. The user selections can be stored as a set of preferences in storage unit 114. Alternatively, in some embodiments, the order of actions taken by controller 108 can be permanently encoded into the logic circuitry of controller 108, or stored as non-modifiable settings in storage unit 114.

In certain embodiments, controller 108 can determine an order of actions based on other considerations. For example, to ensure that spectrometer 100 consumes as little electrical power as possible, the order of actions taken by controller 108 to improve the resolving power of spectrometer 100 can be determined according to increase in power consumption as a result of each action. Controller 108 can be configured with information about how each of the actions disclosed above increases overall power consumption, and can select an appropriate order of actions based on the power consumption information, with actions that cause the smallest increases in power consumption occurring first. Alternatively, controller 108 can be configured to measure the increase in power consumption associated with each of the actions, and can select an appropriate order of actions based on the measured power consumption values.

Although in flow chart 850 adjustments to the configuration of spectrometer 100 are based on the probability that the measured mass spectral information corresponds to known reference information, adjustments to the configuration of spectrometer 100 can also be made based on other criteria. In some embodiments, for example, adjustments to the configuration of spectrometer 100 can be made based on whether or not a target resolution of spectrometer 100 has been achieved. In step 864, controller 108 determines the actual resolution of spectrometer 100 based on the measured mass spectral information (e.g., based on the largest FWHM of a single ion peak within the measurement window of spectrometer 100). In step 866, the actual resolution is compared by controller 108 to a target resolution for spectrometer 100. If the actual resolution is less than the target resolution, then in step 872, controller 108 adjusts the configuration of spectrometer 100, as discussed above, to improve the resolution of the spectrometer.

VIII. Integrated Configurations

In the foregoing discussion, certain embodiments of the disclosed mass spectrometry systems—including ion sources, ion traps, detectors, and/or pumps—are connected via fluid conduits that form portions of gas path 128. However, a number of significant advantages can be realized by integrating one or more of the ion source, ion traps, and detectors with the pump(s) of the systems. In particular, the ion sources, ion traps, and/or detectors can be implemented within a module that is configured to be at least partially received within the system's pump, thereby forming a fully integrated structure.

One advantage of implementing the components of system 100 is this manner is that the total volume of gas path 128 (i.e., the total enclosed volume of system 100) can be reduced. By reducing the enclosed volume, pressure regulation subsystem 120 can achieve a target gas pressure within gas path 128 more quickly. Further, because the enclosed volume is smaller, pressure regulation subsystem 120 does not operate as frequently or for as long. As such, changes to the gas pressure within system 100 can be implemented more rapidly, such as during measurement and analysis of mass spectral information as discussed above, which reduces the overall analysis time and provides information more quickly to a user of the system. Further, by reducing the amount of time during which pressure regulation subsystem 120 operates, the overall power consumption of system 100 is reduced.

Another advantage of implementing the components of system 100 in the above-described manner is that the overall size and weight of system 100 can be reduced. By eliminating fluid conduits between system components, the components are positioned closer together. For systems that are designed to be highly portable or even wearable, reducing the overall size therefore provides important benefits. The reduction in size also brings about a reduction in the internal surface area of the evacuated volume. It can be highly desirable to reduce the internal surface area of the mass spectrometer to minimize the possibility of, and extent of, any contamination that may occur when the spectrometer encounters chemically reactive or absorptive compounds.

A further advantage of eliminating fluid conduits from system 100 is that the system includes fewer gaskets and junctions that it would otherwise have, and therefore the number of potential leakage paths is reduced. Eliminating leakage paths ensures that the amount of time during which pressure regulation subsystem 120 operates is reduced, reducing the overall power consumption of system 100. Moreover, reducing the number and length of fluid conduits also simplifies fabrication and reduces the cost of the systems disclosed herein, as the spectrometer housings can be cast or molded as a single part.

Yet another advantage arising from the above-described configurations is that heat generated from the operation of the pump(s) within the pressure regulation subsystem 120 can be used to heat components within the module, i.e., the ion source, ion trap, and detector. By configuring the shape of the module and the matching recess in the pump housing appropriately, heat transfer from the pump to the components of the module can be achieved. In certain embodiments, some components of the module operate more efficiently at higher temperature, and thereby benefit from heat transferred from the pump(s). Further, for example, by maintaining the temperature of certain components (such as ion trap 104) at an elevated temperature, the risk of contamination of the components can be reduced; that is, hotter temperatures shift the chemical equilibrium within the system further toward the vapor state and therefore reduce the extent to which sample particles will adhere to surfaces within/around the components. As another example, when the sample introduced into system 100 is in solid or liquid form (or adsorbed onto a solid matrix material), heat transferred from the pump(s) can be used to vaporize or desorb sample particles into the gas state so that they can be ionized and analyzed.

Heat transfer from the pump(s) to the components of the module also reduces the overall power consumption of system 100. For example, active cooling of the pump(s) in pressure regulation subsystem 120—which might otherwise be required—can be reduced or even eliminated in the above-described configurations. Further, active heating of certain other components of system 100, such as ion source 102, ion trap 104, and detector 118, can be reduced or even eliminated. Accordingly, the overall power consumption of system 100 during operation can be significantly reduced, which is an important consideration for the portable mass spectrometry systems disclosed herein.

Figure 7:
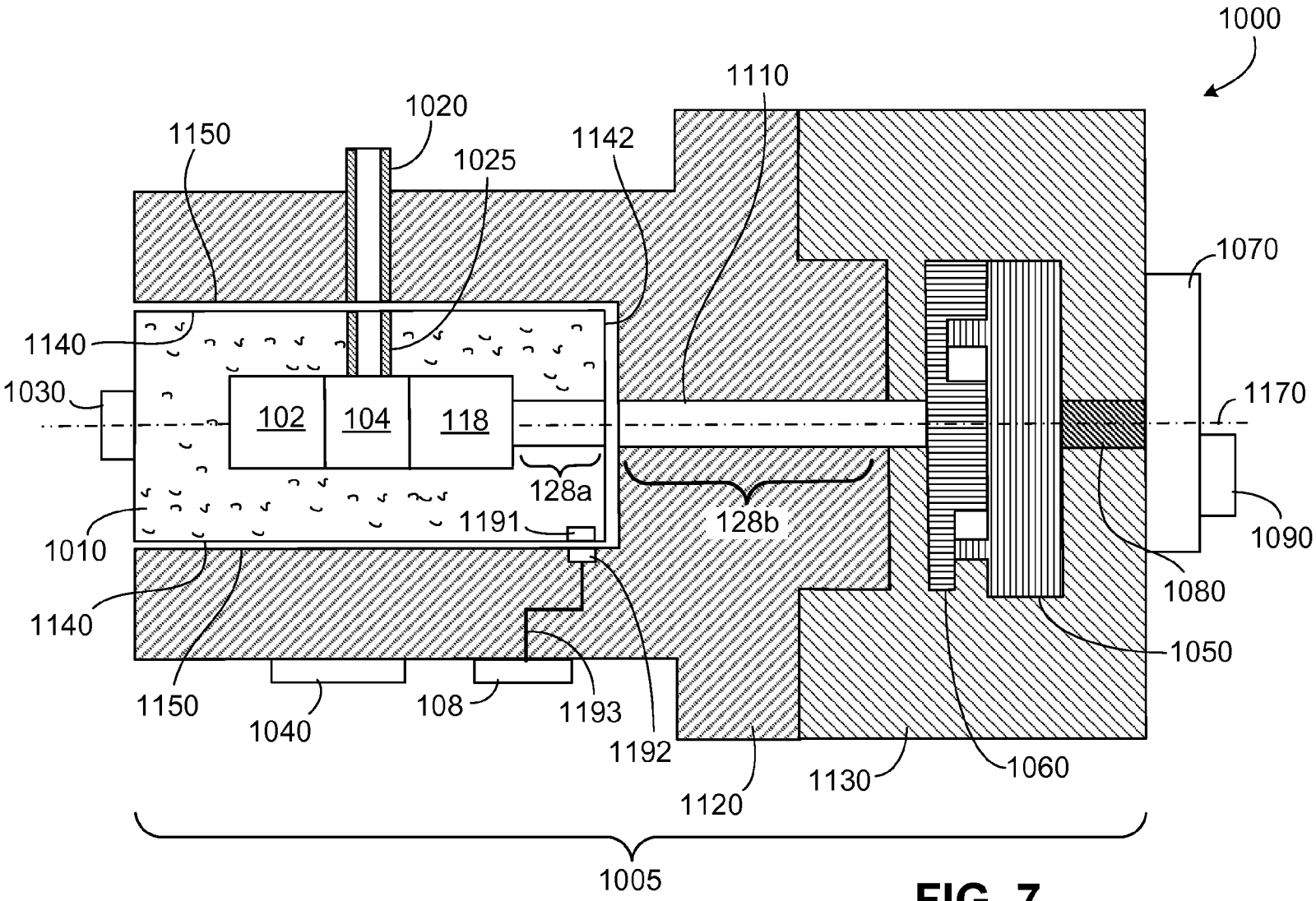
FIG. 7 is a schematic cross-sectional diagram of an embodiment of an integrated, modular mass spectrometry system.

Modular implementation of ion source 102, ion trap 104, and detector 118, and integration of the module with one or more vacuum pumps of pressure regulation subsystem 120, can occur in various ways. FIG. 7 is a cross-sectional view of one embodiment of an integrated, modular mass spectrometry system 1000. System 1000 includes a module 1010 in which an ion source 102, ion trap 104, and detector 118 are positioned. Ion source 102, ion trap 104, and detector 118 are connected along a common gas flow path, a portion of which extends from the right side of detector 118 in FIG. 7 and is labeled 128*a*.

System 1000 also includes a vacuum pump 1005. Vacuum pump 1005 includes a two-part housing formed by a first housing member 1120 and a second housing member 1130. A gas flow path 128*b* extends through portions of both first housing member 1120 and second housing member 1130. In FIG. 7, vacuum pump 1005 is implemented as a scroll pump, and includes a first scroll flange 1060 which is fixed in position and a second scroll flange 1050 that is movable. During operation, a motor 1070 connected to second scroll flange 1050 by shaft 1080 causes second scroll flange 1050 to rotate in an orbital motion relative to first scroll flange 1060. The relative orbital motion of the two flanges traps gases between the interleaved flanges, extracting the gases from gas flow path 128*b* and thereby reducing the gas pressure within gas flow path 128*b*. A counterweight 1090 attached to shaft 1080 counterbalances the rotational force applied by motor 1070 to second scroll flange 1050 so that system 1000 remains rotationally balanced during operation. One or more sensors 1040 can be positioned on first housing member 1120 (as shown in FIG. 7) and/or on second housing member 1130, and can include pressure sensors, temperature sensors, and/or sensors that measure other parameters relevant to the operation of system 1000.

Module 1010 can be inserted and removed from first housing member 1120 using handle 1030, When module 1010 is inserted into first housing member 1120, gas paths 128*a* and 128*b* are aligned to form a continuous gas path 1110 extending from ion source 102 through ion trap 104, detector 118, to first scroll flange 1060. Further, when module 1010 is inserted into first housing member 1120, a thermal transfer surface 1140 of module 1010 contacts a thermal transfer surface 1150 of first housing member 1120, facilitating heat transfer from first housing member 1120 to module 1010.

Upon insertion of module 1010 into first housing member 1120, aperture 1020—which extends through first housing member 1120—is connected to aperture 1025 which extends through module 1010 and is connected to gas path 128*a* within the module. Accordingly, aperture 1020 is connected through module 1010 to continuous gas path 1110. Sample particles can be drawn into system 1000 through aperture 1020 (and aperture 1025) for analysis.

In FIG. 7, apertures 1020 and 1025 form a gas flow path for sample particles from a region external to system 1000 into ion trap 104. Once inside ion trap 104, the sample particles diffused into ion source 102 where they are ionized, and the resulting ions are trapped in circulating fashion within ion trap 104, and then selectively ejected from ion trap 104 and detected by detector 118. However, the configuration shown in FIG. 7 is only one example of the positions of apertures 1020 and 1025 relative to the components of module 1010. As discussed above, in some embodiments, apertures 1020 and 1025 can be positioned so that sample particles are introduced into ion source 102 rather than ion trap 104. In certain embodiments, apertures 1020 and 1025 can be positioned so that sample particles are introduced into detector 118 rather than ion trap 104. In some embodiments, module 1010 does not include an aperture 1025 at all, and sample particles—after being drawn into system 1000 through aperture 1020—enter module 1010 through gas flow path 128*a*. That is, a small gap exists between the apertures of gas flow paths 128*a* and 128*b* that allows sample particles to enter module 1010 for analysis.

First and second housing members 1120 and 1130 can generally be formed from a variety of materials. Typically, at least portions of first and second housing members 1120 are formed from materials that have high thermal conductivity, including metals such as aluminum, copper, and stainless steel. Module 1010 is typically formed from a housing material in which ion source 102, ion trap 104, and detector 118 are positioned. Suitable housing materials can include, for example, various plastic materials such as PTFE (polytetrafluoroethylene), PEEK (polyether ethylketone), FEP (fluorinated ethylene propylene), and/or polycarbonates.

Figure 8:
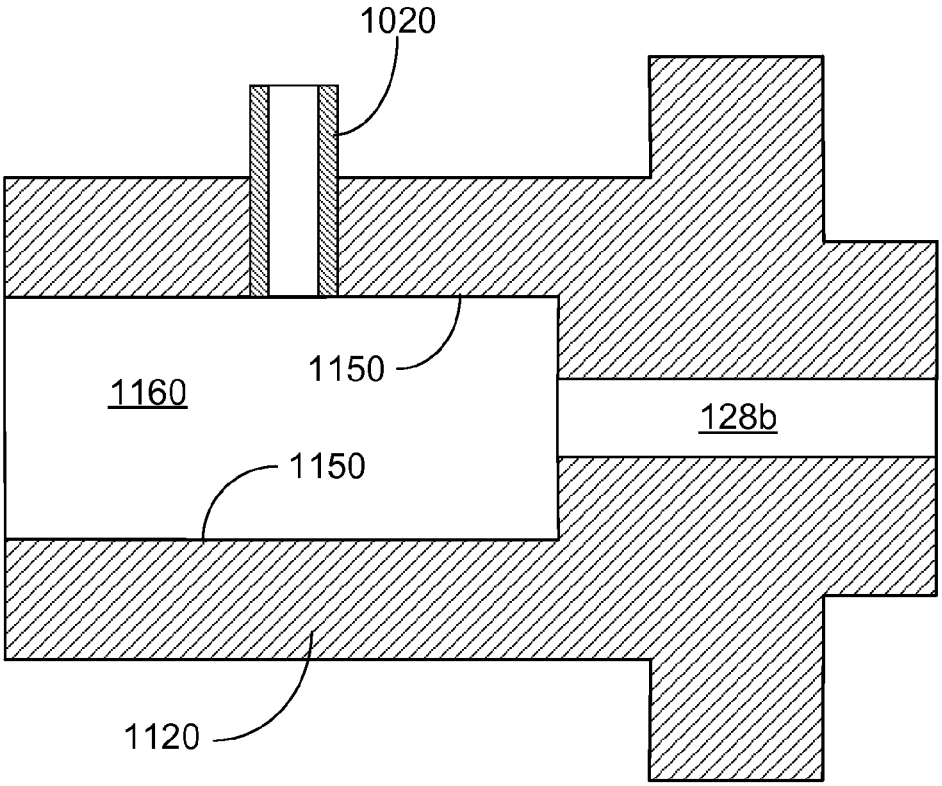
FIG. 8 a schematic cross-sectional diagram of an embodiment of a housing member.

FIG. 8 is a cross-sectional diagram showing only first housing member 1120. As illustrated in FIG. 8, a recess 1160 is formed within first housing member 1120. The lateral surface of the recess corresponds to thermal transfer surface 1150. Recess 1160 is dimensioned to receive module 1010 so that gas flow path 128*a* within module 1010 is coupled to gas flow path 128*b* within first housing member 1120.

Figure 9:
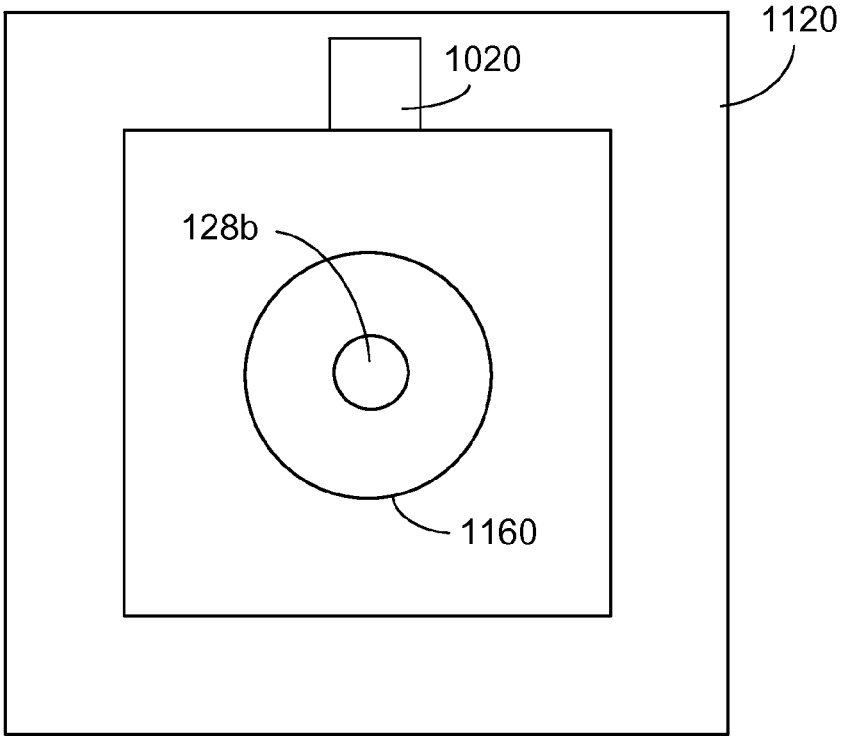
FIG. 9 is a schematic diagram showing a side view of the housing member of FIG. 8.

FIG. 9 is a schematic diagram of a side view of first housing member 1120. As shown in FIG. 9, the cross-sectional shape of recess 1160 is circular, so that recess 1160 is cylindrical in three dimensions. Module 1010 is also therefore cylindrical in shape to facilitate surface contact between module 1010 and the walls of recess 1160, promoting efficient heat transfer between first housing member 1120 and module 1010, and ensuring that there are no gas leakage paths in voids between thermal transfer surfaces 1150 and 1140.

More generally, however, module 1010 and recess 1160 can have a variety of shapes. For example, the shapes of module 1010 and recess 1160 can each be rectangular prismatic, cubic, triangular prismatic, pentagonal prismatic, hexagonal prismatic, or any other right-angled prismatic shape. In some embodiments, the shapes of module 1010 and recess 1160 are more complex regular or irregular forms; provided the shapes of module 1010 and recess 1160 are complementary, they can generally be formed as desired. By using complementary shapes, a sealed connection is formed between module 1010 and first housing member 1120 without the use of gaskets or other degradable mechanical components between at least some of the surfaces of module 1010 and recess 1160. Alternatively, in some embodiments, one or more sealing members (such as gaskets) can optionally be positioned on an outer surface of module 1010 and/or along an inner surface of first housing member 1120 (i.e., along thermal transfer surface 1150) to seal the recess in first housing member 1120 when module 1010 is inserted into first housing member 1120.

Figure 10:
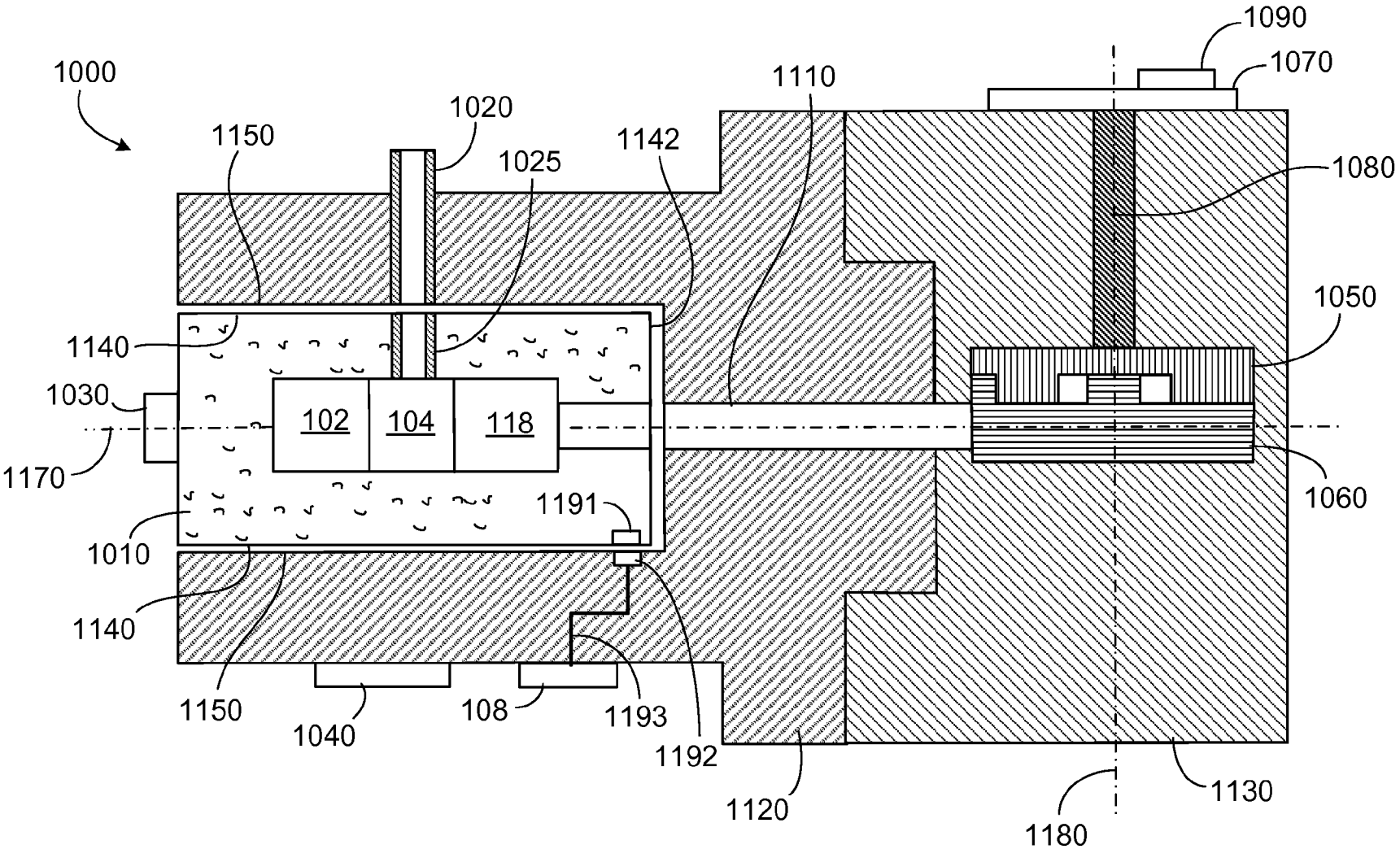
FIG. 10 a schematic cross-sectional diagram of another embodiment of an integrated, modular mass spectrometry system.

Referring again to FIG. 7, an axis 1170 extends along common gas flow path 1110 and the rotational axis of the pump (i.e., the axis about which second scroll flange 1050 rotates) is parallel to axis 1170. However, other configurations are also possible in which the rotational axis of the pump is not parallel to axis 1170. FIG. 10 shows a schematic diagram of a mass spectrometry system 1000 in which many of the features and components are similar to those in FIG. 7, and therefore will not be discussed further. In FIG. 10, the rotational axis of the pump 1180 is orthogonal to the axis 1170 of common gas flow path 1110. Configurations in which the rotational axis of the pump is not parallel to axis 1170 can be useful, for example, to minimize certain types of particle acceleration in ion trap 104 that can induce undesirable piezoelectric noise artifacts.

As discussed above, an important advantage of the integrated implementation of system 1000 shown in FIGS. 7-10 is that the total volume of continuous gas flow path 1110, which includes the interior volumes of ion source 102, ion trap 104, detector 118, and gas flow paths 128*a* and 128*b*, can be significantly reduced relative to systems in which some or all of the system components are connected by fluid conduits. In some embodiments, for example, the total volume of the continuous gas flow path 1110 within system 1000 is 5 $cm^3$ or less (e.g., 4 $cm^3$ or less, 3 $cm^3$ or less, 2 $cm^3$ or less, 1 $cm^3$ or less).

Another important advantage of the systems disclosed herein is that by eliminating fluid conduits linking system components, the total length of the gas flow path can be relatively short. By maintaining a relatively short gas flow path, pressure regulation subsystem 120 can more easily maintain and adjust gas pressures within the system. In some embodiments, a total length of continuous gas flow path 1110 between ion source 102 and first scroll flange 1060 is 2 cm or less (e.g., 1.5 cm or less, 1 cm or less, 0.5 cm or less, 0.25 cm or less, 0.1 cm or less).

In certain embodiments, the co-location of ion source 102, ion trap 104, and detector 118 within module 1010 results in a particularly short gas flow path 128*a* through module 1010. As a result, when module 1010 is positioned within first housing member 1120, a maximum distance between ion source 102 and first housing member 1120, measured in a direction parallel to axis 1170, is 2 cm or less (e.g., 1.5 cm or less, 1 cm or less, 0.5 cm or less, 0.25 cm or less, 0.1 cm or less). Similarly, when module 1010 is positioned within first housing member 1120, a maximum distance between ion trap 104 and first housing member 1120, measured in a direction parallel to axis 1170, is 2 cm or less (e.g., 1.5 cm or less, 1 cm or less, 0.5 cm or less, 0.25 cm or less, 0.1 cm or less), and a maximum distance between detector 118 and first housing member 1120 measured along the same direction is 1 cm or less (e.g., 0.8 cm or less, 0.6 cm or less, 0.5 cm or less, 0.4 cm or less, 0.3 cm or less, 0.2 cm or less, 0.1 cm or less).

While particularly compact systems are obtained when ion source 102, ion trap 104, and detector 118 are all within module 1010, in general one or more of these components can also be positioned external to module 1010, while one or more of the geometric features disclosed herein are still maintained. For example, in some embodiments, ion source 102 is positioned external to module 1010 (e.g., at another location on or within first housing member 1120, in fluid communication with aperture 1020). Ion trap 104 and/or detector 118 can also optionally be positioned outside module 1010 in certain embodiments.

In some embodiments, module 1010 includes one or more electrical connectors that engage or contact electrical connectors internal or external to first and second housing members 1120 and 1130 when module 1010 is positioned within recess 1160. Referring again to FIG. 7, module 1010 includes an electrical connector 1191 positioned on a portion of thermal transfer surface 1140 of the module. Electrical connector 1191 can include individual control lines and terminals connected to any one or more of ion source 102, ion trap 104, detector 118, and any other components within module 1010 (control lines not shown in FIG. 7 for purposes of clarity).

When module 1010 is positioned within recess 1160, electrical connector 1191 engages with or contacts electrical connector 1192, which is positioned on a portion of the wall of recess 1160 (e.g., in a portion of thermal transfer surface 1150). As shown in FIG. 7, electrical connector 1192 is connected via control line 1193 to controller 108. Accordingly, when module 1010 is positioned within recess 1060, each of the components of module 1010—including ion source 102, ion trap 104, and detector 118—can communicate with controller 108, exchanging control signals, measured mass spectral information, and other signals. As discussed above controller 108 can also control various components of pressure regulation subsystem 120, including motor 1070.

In FIGS. 7 and 10, module 1010 and recess 1160 are shaped so that when module 1010 is positioned within recess 1160, first housing member 1120 entirely surrounds thermal transfer surface 1140 of module 1010. In these embodiments, first housing member 1120 also entirely surrounds surface 1142 of module 1010. Thus, as shown in FIGS. 7 and 10, first housing member 1120 entirely surrounds all but one surface (i.e., the surface to which handle 1030 is attached) of module 1010. By increasing the number of surfaces of module 1010 that are surrounded by recess 1060, the efficiency of heat transfer between first housing member 1120 and module 1010 is improved.

Module 1010 and first housing member 1120 can be dimensioned so that thermal transfer surfaces 1140 and 1150 are in full contact, are in partial contact, or do not contact one another at all. In some embodiments, for example, to ensure efficient heat transfer between the surfaces, thermal transfer surfaces 1140 and 1150 are in contact along the entire common lengths of the surfaces (i.e., the entire lengths of the surfaces shown in FIG. 7). In certain embodiments, contact between surfaces 1140 and 1150 occurs over only a portion of surface 1140 and/or surface 1150. In some embodiments, when module 1010 is positioned in recess 1060, surfaces 1140 and 1150 are spaced from one another. In this configuration, electrical connector 1191 can protrude from surface 1140 to facilitate contact with connector 1192.

Figure 11:
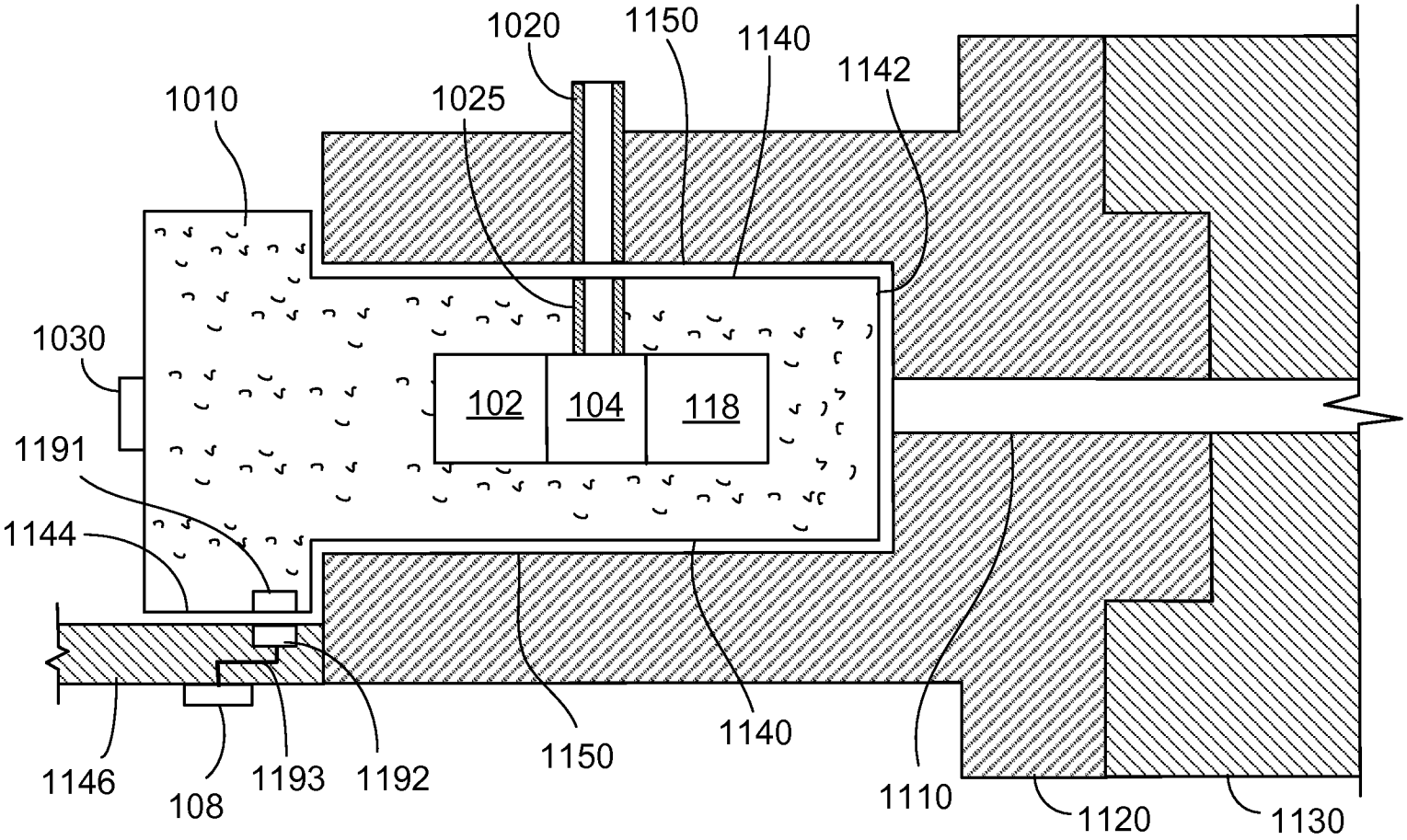
FIG. 11 is a schematic cross-sectional diagram of a portion of an integrated, modular mass spectrometry system.

In some embodiments, module 1010 includes electrical connectors that extend from a surface of module 1010 that is not received within recess 1060. FIG. 11 is a cross-sectional diagram showing a portion of a system 1000 (only first housing member 1120 and module 1010 are shown in FIG. 11 for simplicity). In FIG. 11, electrical connector 1191 is positioned on a surface 1144 of module 1010 that is not received within recess 1060. When module 1010 is positioned within the recess, electrical connector 1191 engages with or contacts electrical connector 1192, which is positioned on a support structure 1146 (e.g., a printed circuit board) and is connected via control line 1193 to controller 108. As discussed above, controller 108 is thereby connected to, and can exchange control signals and data with, the components of module 1010 and the components of pressure regulation subsystem 120 including motor 1070.

Figure 12:
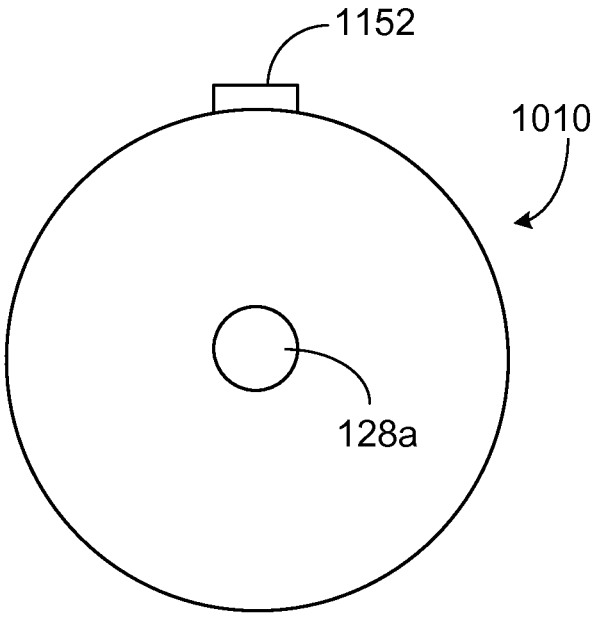
FIG. 12 is a schematic diagram showing a side view of a module with a key.

In addition to the shapes of module 1010 and recess 1060 disclosed above, in some embodiments, module 1010 and recess 1060 can be shaped in complementary fashion so that module 1010 can be inserted in recess 1060 in only one orientation. A wide variety of different complementary shapes can be used to maintain a single orientation of module 1010 within recess 1060. FIG. 12 is a schematic diagram of a side view of one embodiment of a module 1010 with a key 1152 positioned on an outer surface of the module. Recess 1060 can include a complementary groove dimensioned to receive key 1152 when module 1010 is inserted into recess 1060. Because of the position of key 1152, module 1010 is thereby prevented from being inserted into recess 1060 in any orientation but the orientation in which key 1152 is received within the cooperating groove in recess 1060.

Figure 13A:
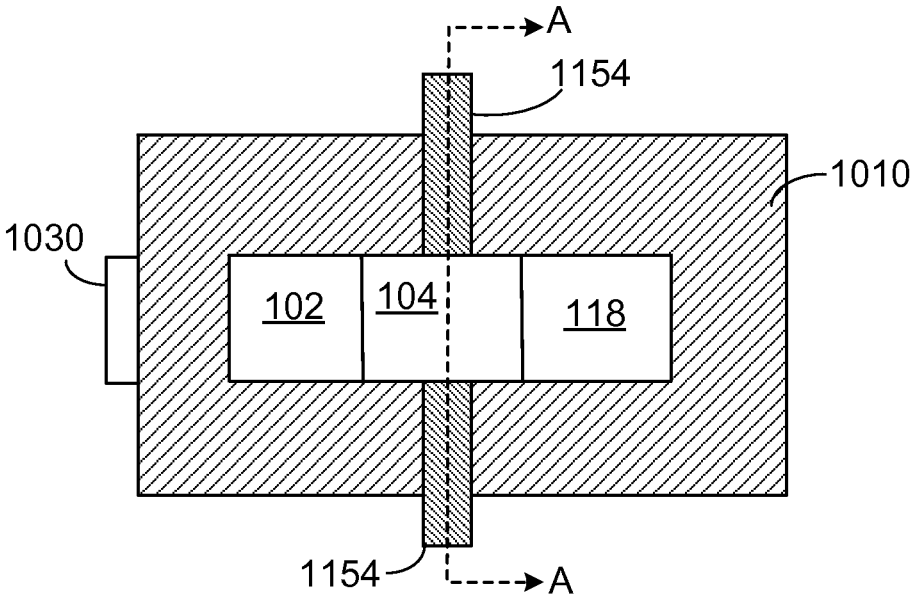
FIG. 13A is a schematic diagram showing a partial cross-sectional view of a module.

In some embodiments, system 1000 can include heat transfer fingers positioned to preferentially direct heat to specific locations within module 1010 from first housing member 1120. FIG. 13A shows a partial cross-sectional view of module 1010. In FIG. 13A, ion source 102, ion trap 104, detector 118, and handle 1030 are not shown in cross-section for simplicity. Module 1010 includes heat transfer fingers 1154 that form protrusions extending from the body of module 1010.

Figure 13B:
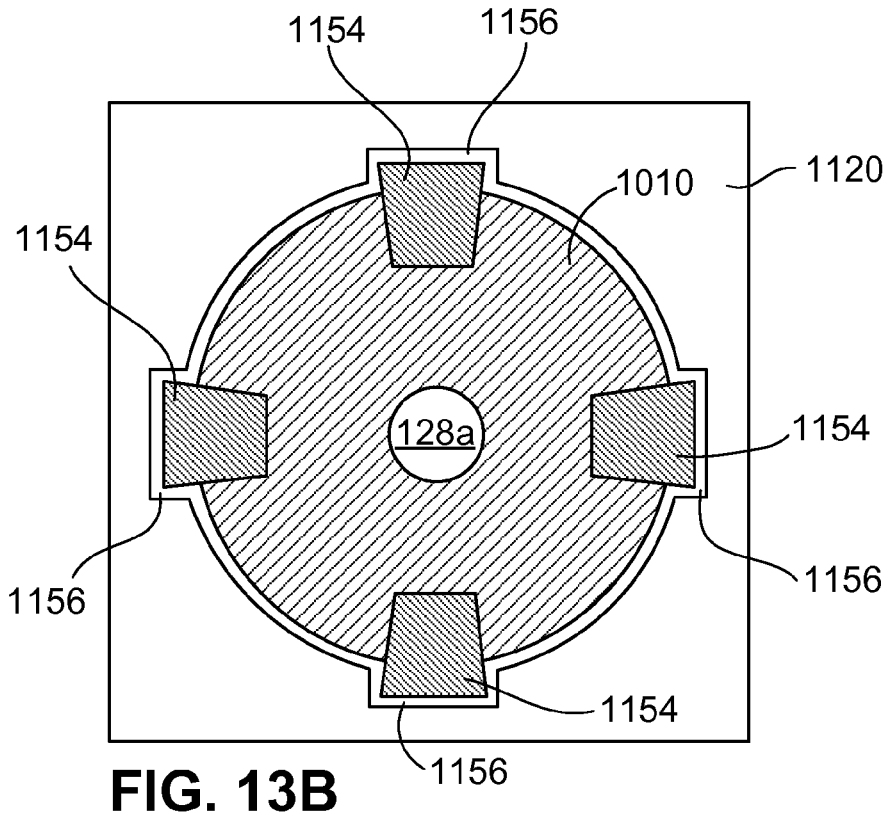
FIG. 13B is a schematic cross-sectional diagram of one embodiment of the module of FIG. 13A.

FIG. 13B is a cross-sectional view of module 1010 through section line A-A in FIG. 13A. First housing member 1120 is also shown for reference in FIG. 13B. First housing member 1120 includes a plurality of cavities 1156. When module 1010 is inserted into recess 1160, heat transfer fingers 1154 are received within cavities 1156 and contact the interior surface of recess 1160 within cavities 1156.

Heat transfer fingers 1154 can generally be formed from a material with a higher thermal conductivity than the housing material that forms module 1010. For example, where module 1010 is formed from a plastic housing material, heat transfer fingers 1154 can be formed from a metallic material such as aluminum, copper, or stainless steel. In certain embodiments, electrical contacts of one or more of ion source 102, ion trap 104, and/or detector 118 function as heat transfer fingers 1154.

In FIGS. 13A and 13B, four heat transfer fingers 1154 are positioned within module 1010. More generally, however, any number of heat transfer fingers 1154 can be used. In some embodiments, for example, the number of heat transfer fingers is 3 or more (e.g., 4 or more, 5 or more, 6 or more, 8 or more). Further, while heat transfer fingers 1154 in FIGS. 13A and 13B are generally shaped as rectangular prisms, more generally heat transfer fingers 1154 can have a wide variety of regular and irregular shapes. Cavities 1156 formed in first housing member 1120 are typically shaped in complementary fashion.

In FIG. 13A, heat transfer fingers 1154 are positioned to preferentially conduct heat from first housing member 1120 to ion trap 104 within module 1010. In general, heat transfer fingers 1154 can be positioned to preferentially conduct heat to any portion of module 1010 or to any component within module 1010. For example, heat transfer fingers 1154 can be positioned to preferentially conduct heat to ion source 102 and/or detector 118. In some embodiments, heat transfer fingers 1154 can be positioned to preferentially conduct heat to at least two of ion source 102, ion trap 104, and detector 118, or even to all three of these components.

Figure 13C:
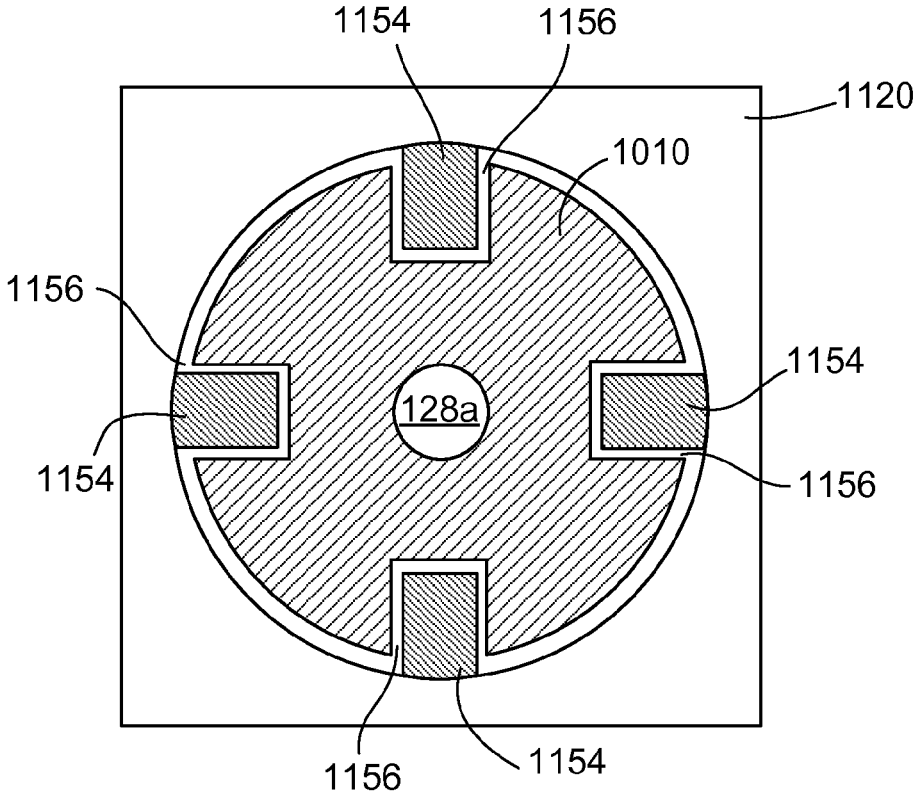
FIG. 13C is a schematic cross-sectional diagram of another embodiment of the module of FIG. 13A.

In some embodiments, heat transfer fingers 1154 are formed as part of first housing member 1120. FIG. 13C shows a cross-sectional diagram of module 1010 and first housing member 1120. In FIG. 13C, a plurality of heat transfer fingers 1154 form protrusions that extend from the interior surface of recess 1160. Module 1010 includes a plurality of corresponding cavities 1156 that are dimensioned to receive heat transfer fingers 1154 when module 1010 is positioned within recess 1160. Heat transfer fingers 1154, even when implemented as protrusions from first housing member 1120, are generally formed from a material with a greater thermal conductivity than the thermal conductivity of the material from which first housing member 1120 is formed. Heat transfer fingers 1154 can be formed from any of the materials disclosed above in connection with FIGS. 13A and 13B. Further, the number and locations of heat transfer fingers 1154 in FIG. 13C can generally be selected as disclosed above to preferentially transfer heat from first housing member 1120 to specific locations and/or components within module 1010.

Hardware, Software, and Electronic Processing

Any of the method steps, features, and/or attributes disclosed herein can be executed by controller 108 (e.g., electronic processor 110 of controller 108) and/or one or more additional electronic processors (such as computers or preprogrammed integrated circuits) executing programs based on standard programming techniques. Such programs are designed to execute on programmable computing apparatus or specifically designed integrated circuits, each comprising a processor, a data storage system (including memory and/or storage elements), at least one input device, and at least one output device, such as a display or printer. The program code is applied to input data to perform functions and generate output information which is applied to one or more output devices. For example, mass spectral information obtained by analyzing a sample using the systems and methods disclosed herein can be outputted to one or more of a display unit and/or a storage unit (e.g., a unit that stores the mass spectral information on one or more tangible media such as optical, magnetic, and other solid state storage media). Each such computer program can be implemented in a high-level procedural or object-oriented programming language, or an assembly or machine language. Furthermore, the language can be a compiled or interpreted language. Each such computer program can be stored on a computer readable storage medium (e.g., optical storage medium such as CD-ROM or DVD, magnetic storage medium, and/or persistent solid state storage medium) that, when read by a computer, processor, or electronic circuit, can cause the computer, processor, or electronic circuit to perform the analysis and control functions described herein.

OTHER EMBODIMENTS

A number of embodiments have been described. Nevertheless, it will be understood that various modifications may be made without departing from the spirit and scope of the disclosure. Accordingly, other embodiments are within the scope of the following claims.

What is claimed is:

1. A mass spectrometry system, comprising:
an ion source;
a module comprising:
an ion trap and an ion detector; and
a module housing that at least partially surrounds the ion trap and the ion detector; and
a vacuum pump comprising a housing having a recess dimensioned to receive the module,
wherein when the module is positioned within the recess of the vacuum pump housing, a portion of the module is surrounded by the vacuum pump housing; and
wherein during operation of the system, when the module is positioned within the recess of the vacuum pump housing:
the ion source, ion trap, ion detector, and vacuum pump are connected along a common gas flow path; and
heat is transferred from the vacuum pump to the module.

2. The system of claim 1, wherein the ion source is a component of the module.

3. The system of claim 1, wherein the ion source is positioned external to the module, and wherein the common gas flow path extends through the module housing to connect the ion source to the ion trap, ion detector, and vacuum pump.

4. The system of claim 1, wherein the module comprises a first thermal transfer surface and the vacuum pump housing comprises a second thermal transfer surface, and during operation of the system, the first thermal transfer surface contacts the second thermal transfer surface to transfer heat from the vacuum pump to the module.

5. The system of claim 1, wherein the common gas flow path has a volume of 5 $cm^3$ or less.

6. The system of claim 1, wherein the common gas flow path has a volume of 3 $cm^3$ or less.

7. The system of claim 1, wherein the vacuum pump comprises one or more of a scroll pump comprising interleaved scroll flanges, a roots blower pump, and a rotor/stator pump.

8. The system of claim 7 wherein the vacuum pump comprises a scroll pump comprising interleaved scroll flanges, and wherein a minimum length of the common gas flow between the ion source and the interleaved scroll flanges is 2 cm or less.

9. The system of claim 7, wherein the vacuum pump comprises a scroll pump comprising an interleaved fixed flange and a movable flange, and wherein the fixed flange is positioned closer to the recess than the movable flange.

10. The system of claim 4, wherein the module is configured to form a sealed connection with the vacuum pump when the module is received within the recess, and wherein at least some surfaces of contact between the module and the recess are gasketless.

11. The system of claim 4, wherein the first thermal transfer surface comprises an exterior surface of a cylindrical member.

12. The system of claim 1, wherein during operation, the vacuum pump is configured to maintain a gas pressure within the common gas flow path of between 10 mTorr and 100 Torr.

13. The system of claim 12, wherein during operation, the vacuum pump is configured to maintain the gas pressure so that gas pressures among the ion source, the ion trap, and the ion detector differ by less than 100 mTorr.

14. The system of claim 1, wherein the module comprises a first gas flow path, the vacuum pump comprises a second gas flow path, and wherein the first and second gas flow paths extend along a common axis to form the common gas flow path.

15. The system of claim 14, wherein the module comprises a sample inlet having an inlet flow path extending in a direction perpendicular to the first gas flow path and connected to the first gas flow path.

16. The system of claim 1, wherein the module comprises a first gas flow path, the vacuum pump comprises an internal axis of rotation, and wherein the first gas flow path and the axis of rotation extend in different directions.

17. The system of claim 16, wherein the first gas flow path and the axis of rotation extend in perpendicular directions.

18. The system of claim 1, wherein the module comprises a plurality of electrical connectors extending from a surface of the module, and wherein during operation, when the module is positioned within the recess, the plurality of electrical connectors engage with a support structure comprising an electronic processor.

19. The system of claim 18, wherein the electronic processor is configured to control the ion source, the ion trap, the ion detector, and the vacuum pump.

20. The system of claim 4, wherein:

the module comprises a plurality of electrical connectors extending from a surface of the module that is received within the recess;

the vacuum pump comprises a plurality of corresponding electrical connectors configured to engage with the connectors of the module; and during operation, when the module is positioned within the recess, the module is electrically connected to an electronic processor through the connectors of the vacuum pump.

21. The system of claim 20, wherein the electronic processor is configured to control the ion source, the ion trap, the ion detector, and the vacuum pump.

22. The system of claim 4, wherein the recess and an exterior surface of the module are shaped so that the module can be received within the recess in only one orientation.

23. The system of claim 4, wherein the recess is dimensioned so that when the module is positioned within the recess, the vacuum pump housing entirely surrounds at least one exterior surface of the module.

24. The system of claim 4, wherein the recess is dimensioned so that when the module is positioned within the recess, the vacuum pump housing entirely surrounds more than one exterior surface of the module.

25. The system of claim 4, wherein the recess is dimensioned so that when the module is positioned within the recess, the vacuum pump housing entirely surrounds all but one exterior surface of the module.

26. The system of claim 1, wherein the recess comprises a cavity, and wherein the module comprises a protruding member dimensioned to be received within the cavity when the module is received within the recess.

27. The system of claim 26, wherein the protruding member is formed from a metallic material.

28. The system of claim 26, wherein the recess comprises a plurality of cavities, and wherein the module comprises a plurality of corresponding protruding members dimensioned to be received within the cavities when the module is received within the recess.

29. The system of claim 1, wherein the module comprises a cavity, and wherein the vacuum pump housing comprises a protruding member dimensioned to be received within the cavity when the module is received within the recess.

30. The system of claim 29, wherein the module comprises a plurality of cavities, and wherein the vacuum pump housing comprises a plurality of protruding members dimensioned to be received within the cavities when the module is received within the recess.

31. A method, comprising:

introducing a sample into a mass spectrometry system comprising:

an ion source;

a module comprising:

an ion trap and an ion detector; and a module housing that at least partially surrounds the ion trap and the ion detector; and a vacuum pump comprising a housing having a recess dimensioned to receive the module, wherein when the module is positioned within the recess of the vacuum pump housing, a portion of the module is surrounded by the vacuum pump housing; and wherein during operation of the system, when the module is positioned within the recess of the vacuum pump housing:

the ion source, ion trap, ion detector, and vacuum pump are connected along a common gas flow path; and heat is transferred from the vacuum pump to the module;

generating ions from the sample using the ion source;

trapping the generated ions within the ion trap;

selectively ejecting the trapped ions from the ion trap and detecting the ejected ions using the ion detector to determine mass spectral information about the sample; and outputting the mass spectral information to at least one of a display unit and a storage unit.

* * * * *